US006668924B2

(12) United States Patent
Bolze et al.

(10) Patent No.: US 6,668,924 B2
(45) Date of Patent: Dec. 30, 2003

(54) REDUCED CONTAMINATION SAMPLING

(75) Inventors: Victor M. Bolze, Houston, TX (US); Jonathan W. Brown, Dunecht (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/065,603

(22) Filed: Nov. 1, 2002

(65) Prior Publication Data

US 2003/0042021 A1 Mar. 6, 2003

Related U.S. Application Data

(63) Continuation-in-part of application No. 09/960,570, filed on Sep. 20, 2001, which is a continuation-in-part of application No. 09/712,373, filed on Nov. 14, 2000, now Pat. No. 6,467,544.

(51) Int. Cl.[7] ..... E21B 49/08; E21B 49/10
(52) U.S. Cl. ..... 166/264; 166/167; 175/99
(58) Field of Search ..... 166/264, 163, 166/165, 167; 175/20, 58, 59

(56) References Cited

U.S. PATENT DOCUMENTS

| | | | |
|---|---|---|---|
| 3,385,364 | A | 5/1968 | Whitten |
| 3,969,937 | A | 7/1976 | Barrington et al. |
| 4,434,653 | A | 3/1984 | Montgomery |
| 4,703,799 | A | 11/1987 | Jennings, Jr. et al. |
| 4,745,802 | A | 5/1988 | Purfurst |
| 4,860,581 | A | 8/1989 | Zimmerman et al. |
| 4,879,900 | A | 11/1989 | Gilbert |
| 4,936,139 | A | 6/1990 | Zimmerman et al. |
| 4,994,671 | A | 2/1991 | Safinya et al. |
| 5,056,595 | A | 10/1991 | Desbrandes |
| 5,166,747 | A | 11/1992 | Schroeder et al. |
| 5,269,180 | A | 12/1993 | Dave et al. |
| 5,303,775 | A | 4/1994 | Michaels et al. |
| 5,337,822 | A | 8/1994 | Massie et al. |
| 5,377,755 | A | 1/1995 | Michaels et al. |
| 5,609,205 | A | 3/1997 | Massie et al. |
| 5,644,076 | A | 7/1997 | Proett et al. |
| 5,662,166 | A | 9/1997 | Shammai |
| 5,890,549 | A | 4/1999 | Sprehe |
| 5,901,788 | A | 5/1999 | Brown et al. |
| 5,934,374 | A | 8/1999 | Hrametz et al. |
| 5,939,717 | A | 8/1999 | Mullins |
| 5,956,132 | A | 9/1999 | Donzier |
| 6,216,804 | B1 | 4/2001 | Aumann et al. |
| 6,328,103 | B1 | 12/2001 | Pahmiyer et al. |
| 6,378,631 | B1 | 4/2002 | Aumann et al. |

FOREIGN PATENT DOCUMENTS

| | | |
|---|---|---|
| EP | 0 791 723 A1 | 8/1997 |

OTHER PUBLICATIONS

Crocker, H. et al., An Improved Wireline Formation Fluid Sampler and Tester, Society of Petroleum Engineers SPE 22971, Nov. 4–7, 1991, pp. 237–244.

Neville, Norman, RFT Backflush Solves Probe–Plugging Problem, Technical Review, vol. 26, No. 4, pp. 15–20.

*Primary Examiner*—David Bagnell
*Assistant Examiner*—Jennifer Hawkins Gay
(74) *Attorney, Agent, or Firm*—J. L. Jennie Salazar; Brigitte L. Jeffery; John J. Ryberg

(57) ABSTRACT

A downhole sampling tool and related method are provided. The tool is provided with a main flowline for communicating fluid from the formation through the tool. A main valve is positioned in the main flowline and defines a first portion and a second portion of the main flowline. At least one sample chamber with a slidable piston therein defining a sample cavity and a buffer cavity is also provided. The sample cavity is in selective fluid communication with the first portion of the main flowline via a first flowline and with the second portion of the main flowline via a second flowline. Fluid communication is selectively established between the sample cavity and the first and/or second portions of the main flowline for selectively flushing fluid through the sample cavity and/or collecting samples of the fluid therein. Fluid may also be discharged from the buffer cavity via a third flowline.

30 Claims, 23 Drawing Sheets

M
High Pressure
Low Pressure
SM
130
110p
112
110c
54
120
122
118
128
From Reservoir
110

REDUCED CONTAMINATION SAMPLING

CROSS REFERENCE TO RELATED APPLICATIONS

The present application is a continuation-in-part of U.S. application Ser. No. 09/960,570 filed on Sep. 20, 2001, which is a continuation-in-part of Ser. No. 09/712,373 U.S. Pat. No. 6,467,544 filed on Nov. 14, 2000.

BACKGROUND OF INVENTION

This invention relates generally to sampling formation fluid from a wellbore. More specifically, the invention relates to reducing the contamination present in a sampling operation thereby providing a cleaner sample of formation fluids.

The desirability of taking downhole formation fluid samples for chemical and physical analysis has long been recognized by oil companies, and such sampling has been performed by the assignee of the present invention, Schlumberger, for many years. Samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance.

The process of wellbore sampling involves the lowering of a sampling tool, such as the MDT™ formation testing tool, owned and provided by Schlumberger, into the wellbore to collect a sample or multiple samples of formation fluid by engagement between a probe member of the sampling tool and the wall of the wellbore. The sampling tool creates a pressure differential across such engagement to induce formation fluid flow into one or more sample chambers within the sampling tool. This and similar processes are described in U.S. Pat. Nos. 4,860,581; 4,936,139 (both assigned to Schlumberger); 5,303,775; 5,377,755 (both assigned to Western Atlas); and 5,934,374 (assigned to Halliburton).

The desirability of housing at least one, and often a plurality, of such sample chambers, with associated valving and flow line connections, within "sample modules" is also known, and has been utilized to particular advantage in Schlumberger's MDT tool. Schlumberger currently has several types of such sample modules and sample chambers, each of which provide certain advantages for certain conditions.

"Dead volume" is a phrase used to indicate the volume that exits between the seal valve at the inlet to a sample cavity of a sample chamber and the sample cavity itself. In operation, this volume, along with the rest of the flow system in a sample chamber or chambers, is typically filled with a fluid, gas, or a vacuum (typically air below atmospheric pressure), although a vacuum is undesirable in many instances because it allows a large pressure drop when the seal valve is opened. Thus, many high quality samples are now taken using "low shock" techniques wherein the dead volume is almost always filled with a fluid, usually water. In any case, whatever is used to fill this dead volume is swept into and captured in the formation fluid sample when the sample is collected, thereby contaminating the sample.

The problem is illustrated in FIG. 1, which shows sample chamber 10 connected to main flow line 9 via secondary line 11. Fluid flow from main flow line 9 into secondary line 11 is controlled by manual shut-off valve 17 and surface-controllable seal valve 15. Manual shut-off valve 17 is typically opened at the surface prior to lowering the tool containing sample chamber 10 into a borehole (not shown in FIG. 1), and then shut at the surface to positively seal a collected fluid sample after the tool containing sample chamber 10 is withdrawn from the borehole. Thus, the admission of formation fluid from flow line 9 into sample chamber 10 is essentially controlled by opening and closing seal valve 15 via an electronic command delivered from the surface through an armored cable known as a "wireline," as is well known in the art. The problem with such sample fluid collection is that dead volume fluid DV is collected in sample chamber 10 along with the formation fluid delivered through flow line 9, thereby contaminating the fluid sample.

It is, therefore, desirable to provide techniques for removing contamination from the downhole tool so that cleaner fluid samples may be captured. It is further desirable that such techniques apply to downhole tools with one or more sample chambers within the downhole tool, one or more sample chambers in the same sampling location within the downhole tool, and/or sample chambers located at any location in the downhole tool along the main flowline.

The present invention is directed to a method and apparatus that may solve or at least reduce, some or all of the problems described above.

SUMMARY OF INVENTION

The sample module can further comprise a second valve disposed in the first flowline between the second flowline and the third flowline, and the second flowline can be connected to the first flowline upstream of said second valve. The third flowline can be connected to the first flowline downstream of the second valve. There can also be a fourth flowline connected to the sample cavity of the sample chamber for communicating fluid out of the sample cavity. The fourth flowline can also be connected to the first flowline, whereby fluid preloaded in the sample cavity may be flushed out using formation fluid via the fourth flowline. In one particular embodiment, the fourth flowline is connected to the first flowline downstream of the second valve. A third valve can be disposed in the fourth flowline for controlling the flow of fluid through the fourth flowline. The sample module can be a wireline-conveyed formation testing tool. In exemplary embodiments of the invention the sample cavity and the buffer cavity have a pressure differential between them that is less than 50 psi. In other exemplary embodiments of the invention, the sample cavity and the buffer cavity have a pressure differential between them that is less than 25 psi and less than 5 psi.

An alternate embodiment comprises a sample module for obtaining fluid samples from a subsurface wellbore. The sample module comprising a sample chamber for receiving and storing pressurized fluid with a piston movably disposed in the chamber defining a sample cavity and a buffer cavity, the cavities having variable volumes determined by movement of the piston. A first flowline for communicating fluid obtained from a subsurface formation proceeds through the sample module along with a second flowline connecting the first flowline to the sample cavity. A third flowline is connects the first flowline to the buffer cavity of the sample chamber for communicating buffer fluid out of the buffer cavity. A first valve capable of moving between a closed position and an open position is disposed in the second flowline for communicating flow of fluid from the first flowline to the sample cavity. A second valve capable of moving between a closed position and an open position is disposed in the first flowline between the second flowline and the third flowline. When the first valve and the second valve are in the open position, the sample cavity and the buffer cavity are in fluid communication with the first flowline and therefore have approximately equivalent pressures. The sample cavity and the buffer cavity can have a pressure differential between them that is less than 50 psi, less than 25 psi or less than 5 psi.

In another embodiment, the invention is directed to an apparatus for obtaining fluid from a subsurface formation penetrated by a wellbore. The apparatus comprises a probe assembly for establishing fluid communication between the apparatus and the formation when the apparatus is positioned in the wellbore. A pump assembly is capable of drawing fluid from the formation into the apparatus via the probe assembly. A sample module is capable of collecting a sample of the formation fluid drawn from the formation by the pumping assembly. The sample module comprises a chamber for receiving and storing fluid and a piston slidably disposed in the chamber to define a sample cavity and a buffer cavity, the cavities having variable volumes determined by movement of the piston. A first flowline is in fluid communication with the pump assembly for communicating fluid obtained from the formation through the sample module. A second flowline connects the first flowline to the sample cavity and a first valve is disposed in the second flowline for controlling the flow of fluid from said first flowline to the sample cavity. When the first valve is in the open position, the sample cavity and the buffer cavity are in fluid communication with the first flowline and thereby have approximately equivalent pressures.

The apparatus can further comprise a second valve disposed in the first flowline between the second flowline and the third flowline. The second flowline can be connected to the first flowline upstream of the second valve, while the third flowline can be connected to the first flowline downstream of the second valve. A fourth flowline can be connected to the sample cavity of the sample chamber for communicating fluid into and out of the sample cavity. The fourth flowline can also be connected to the first flowline, whereby any fluid preloaded in the sample cavity can be flushed out using formation fluid via the fourth flowline. The fourth flowline can be connected to the first flowline downstream of the second valve and can comprise a third valve controlling the flow of fluid through the fourth flowline. The apparatus can be a wireline-conveyed formation testing tool.

The inventive apparatus is typically a wireline-conveyed formation testing tool, although the advantages of the present invention are also applicable to a logging-while-drilling (LWD) tool such as a formation tested carried in a drillstring. The pressure differential between the sample cavity and the buffer cavity can be less than 50 psi, less than 25 psi or less than 5 psi.

Yet another embodiment of the present invention can comprise a method for obtaining fluid from a subsurface formation penetrated by a wellbore. The method comprises positioning a formation testing apparatus within the wellbore, the testing apparatus comprising a sample chamber having a floating piston slidably positioned therein, so as to define a sample cavity and a buffer cavity. Fluid communication is established between the apparatus and the formation and movement of fluid from the formation through a first flowline in the apparatus is induced with a pump located downstream of the first flowline. Communication between the sample cavity and the first flowline, and between the buffer cavity and the first flowline are established whereby the sample cavity, buffer cavity and the first flowline have equivalent pressures. Buffer fluid is removed from the buffer cavity, thereby moving the piston within the sample chamber and delivering a sample of the formation fluid into the sample cavity of a sample chamber. The apparatus is then withdrawn from the wellbore to recover the collected sample.

The method can further comprise flushing out at least a portion of a fluid precharging the sample cavity by inducing movement of at least a portion of the formation fluid though the sample cavity and collecting a sample of the formation fluid within the sample cavity after the flushing step. The flushing step can be accomplished with flow lines leading into and out of the sample cavity. Each of the flow lines can be equipped with a seal valve for controlling fluid flow therethrough. The flushing step can include flushing the precharging fluid out to the borehole or into a primary flow line within the apparatus. The method can further comprise the step of maintaining the sample collected in the sample cavity in a single phase condition as the apparatus is withdrawn from the wellbore.

In one particular embodiment the formation fluid is drawn into the sample cavity by movement of the piston as the buffer fluid is withdrawn from the buffer cavity and the expelled buffer fluid is delivered to a primary flow line within the apparatus. The pressure differential between the sample cavity and the first flowline can be less than 50 psi, less than 25 psi, or less than 5 psi. The fluid movement from the formation into the apparatus can be induced by a probe assembly engaging the wall of the formation, and a pump assembly that is in fluid communication with the probe assembly, both assemblies being within the apparatus.

In another aspect, the present invention relates to a downhole sampling tool positionable in a wellbore penetrating a subterranean formation. The downhole tool comprises a main flowline extending through the downhole tool for communicating fluid obtained from the formation through the downhole tool. A main valve in the main flowline is movable between a closed and an open position. The valve defines a first portion and a second portion of the main flowline. At least one sample chamber has a slidable piston therein defining a sample cavity and a buffer cavity. The sample cavity is in selective fluid communication with the first portion of the main flowline via a first flowline and in selective fluid communication with the second portion of the main flowline via a second flowline. When the main valve is in the closed position, fluid communication is selectively established between the sample cavity and one of the first portion of the main flowline, the second portion of the main flowline and combinations thereof.

In another aspect, the invention relates to a method for obtaining fluid from a subsurface formation penetrated by a wellbore. The method comprises positioning a formation testing apparatus within the wellbore, the testing apparatus comprising a sample chamber having a floating piston slidably positioned therein so as to define a sample cavity and a buffer cavity. Fluid communication is established between the apparatus and the formation. The movement of fluid is induced from the formation through a main flowline in the apparatus. Fluid is diverted from the main flowline into the sample cavity via a first flowline. Fluid is discharged from the sample cavity via a second flowline whereby fluid is flushed from the sample cavity. The discharge of fluid from the sample cavity is terminated whereby a sample is collected in the sample cavity.

In another aspect, the invention relates to a downhole sampling tool positionable in a wellbore penetrating a subterranean formation. The downhole sampling tool comprises a probe assembly for establishing fluid communication between the apparatus and the formation when the apparatus is positioned in the wellbore and a pump assembly for drawing fluid from the formation into the apparatus via said probe assembly. A main flowline extends through the downhole tool for communicating fluid obtained from the formation through the downhole tool. A main valve in the main flowline is movable between a closed and an open position. The valve defines a first portion and a second portion of the main flowline. The tool also comprises a sample module for collecting a sample of the formation fluid drawn from the formation by said pumping assembly. The module comprises at least one sample chamber have a slidable piston therein defining a sample cavity and a buffer cavity. The sample cavity is in selective fluid communication with the first portion of the main flowline via a first flowline and in selective fluid communication with the second portion of the main flowline via a second flowline. When the main valve is in the closed position, fluid communication is selectively established between the sample cavity and one of the first portion of the main flowline, the second portion of the main flowline and combinations thereof.

Other aspects of the invention will be further provided herein.

BRIEF DESCRIPTION OF DRAWINGS

The manner in which the present invention attains the above recited features, advantages, and objects can be understood with greater clarity by reference to the preferred embodiments thereof that are illustrated in the accompanying drawings. It is to be noted however, that the appended drawings illustrate only typical embodiments of this invention and are therefore not to be considered limiting of its scope, for the invention may admit to other equally effective embodiments.

DETAILED DESCRIPTION

Figure 1:
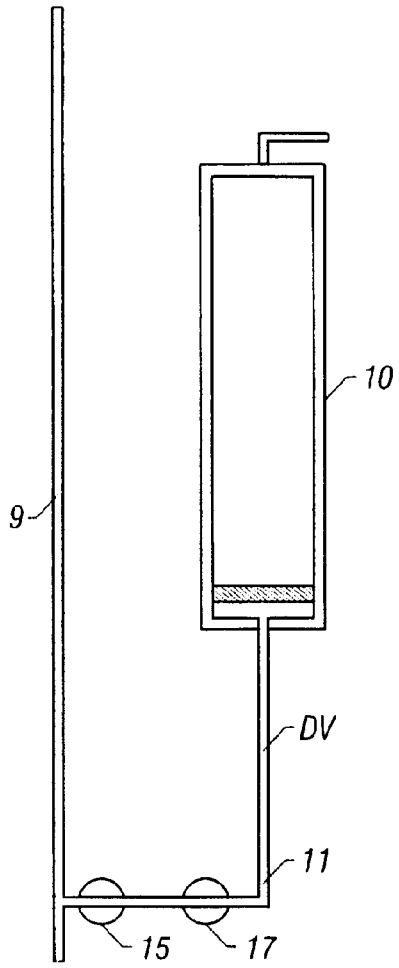
FIG. 1 (Prior Art)
FIG. 1 is a simplified schematic of a prior art sample module, illustrating the problem of dead volume contamination.

FIG. 1 illustrates a simplified schematic of a prior art sample module 10, illustrating how fluid from flowline 9 can be routed through flowline 11 and two valves 15, 17 and enter the sample module 10. In this embodiment there is a dead volume DV that is not capable of being flushed out and can therefore contaminate any sample fluid collected within the sample module 10. In addition the fluid sample collected may be subject to pressure changes during the sampling operation that can alter the fluid properties.

Figure 2:
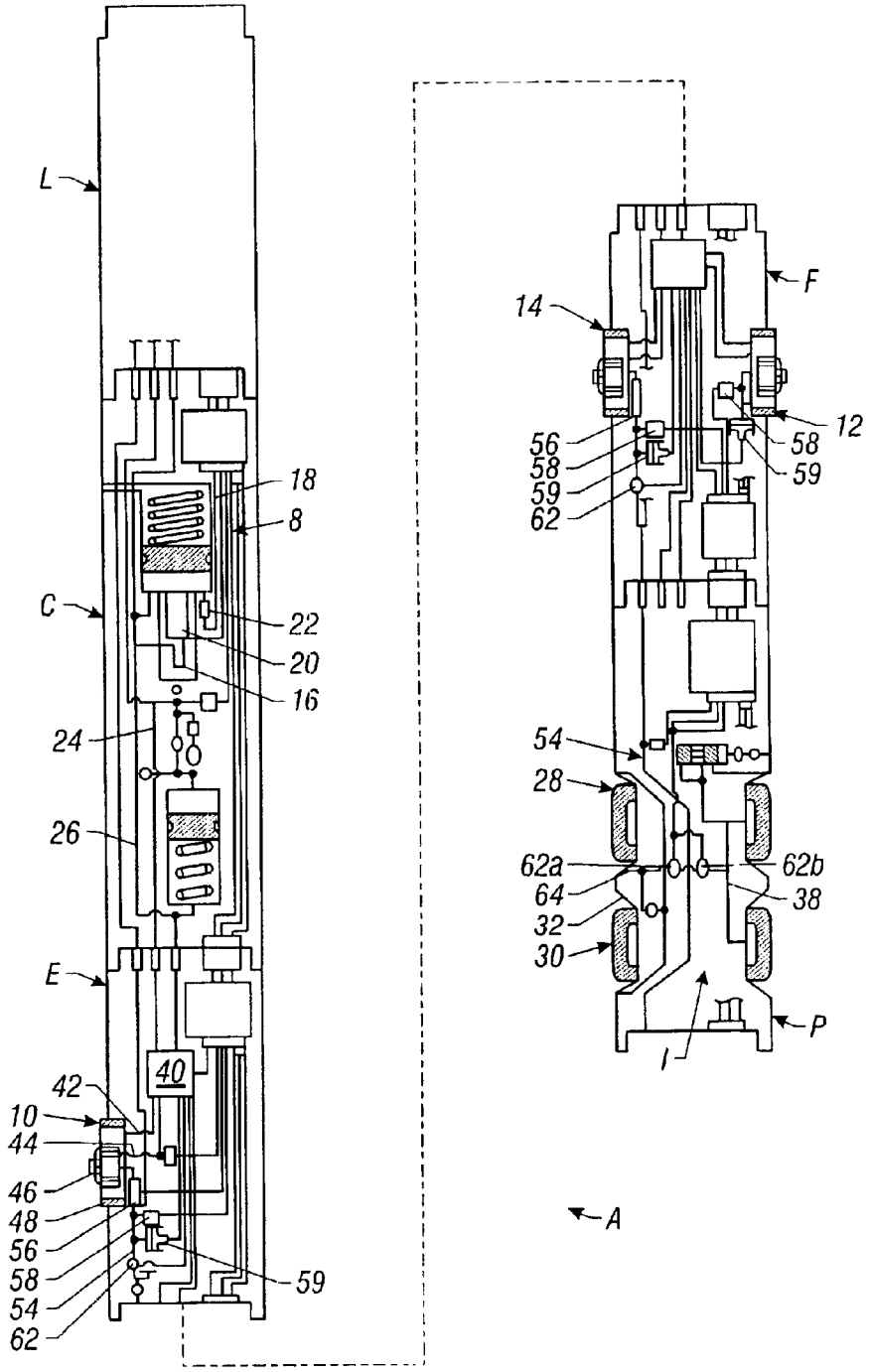
FIG. 2 (Prior Art)
FIGS. 2 and 3 are schematic illustrations of a prior art formation testing apparatus and its various modular components.
Figure 3:
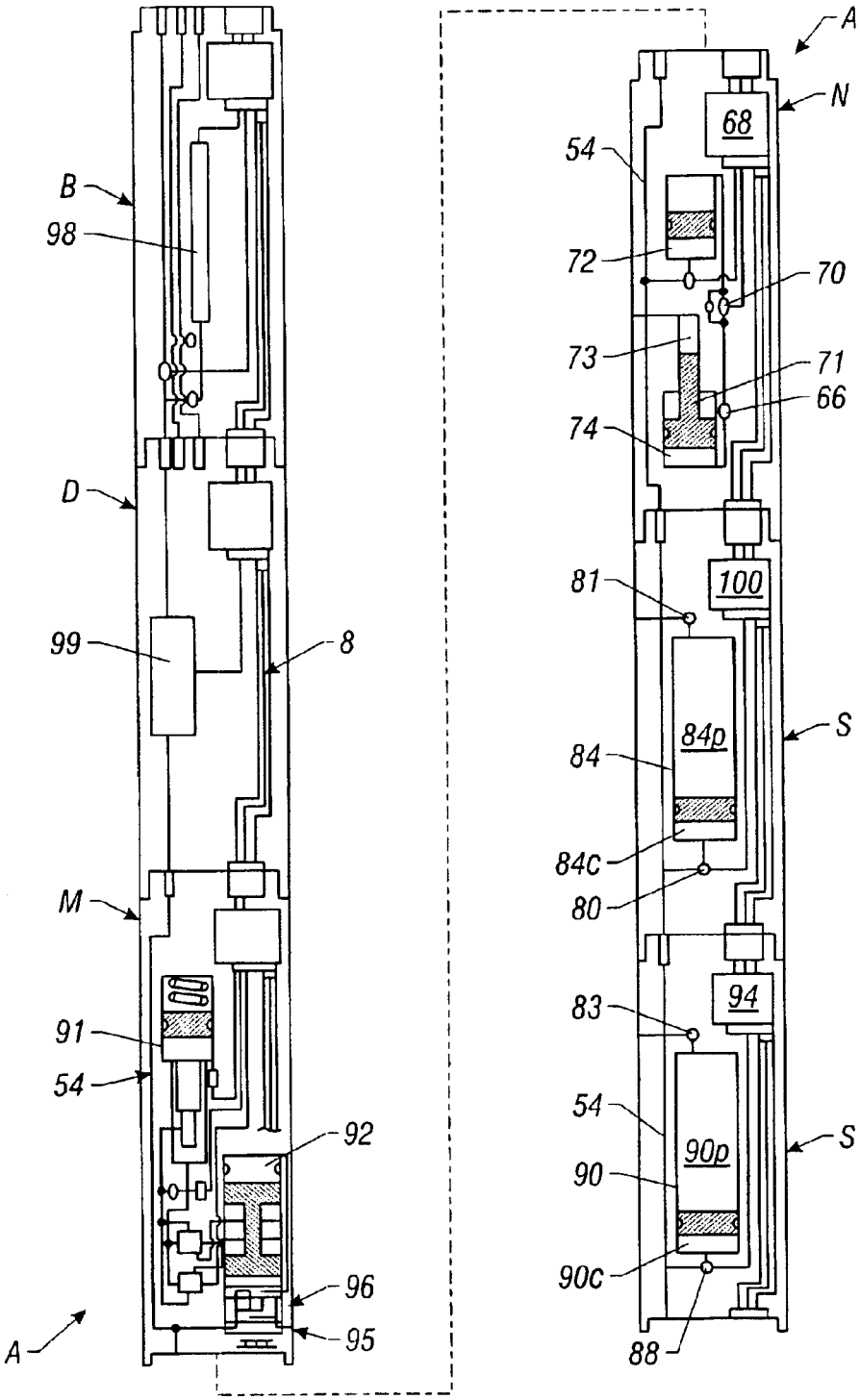
FIG. 3 (Prior Art)

Turning now to prior art FIGS. 2 and 3, an apparatus with which the present invention may be used to advantage is illustrated schematically. The apparatus A of FIGS. 2 and 3 is of modular construction, although a unitary tool is also useful. The apparatus A is a down hole tool which can be lowered into the well bore (not shown) by a wire line (not shown) for the purpose of conducting formation property tests. A presently available embodiment of such a tool is the MDT (trademark of Schlumberger) tool. The wire line connections to tool A as well as power supply and communications-related electronics are not illustrated for the purpose of clarity. The power and communication lines that extend throughout the length of the tool are generally shown at 8. These power supply and communication components are known to those skilled in the art and have been in commercial use in the past. This type of control equipment would normally be installed at the uppermost end of the tool adjacent the wire line connection to the tool with electrical lines running through the tool to the various components.

As shown in the embodiment of FIG. 2, the apparatus A has a hydraulic power module C, a packer module P, and a probe module E. Probe module E is shown with one probe assembly 10 which may be used for permeability tests or fluid sampling. When using the tool to determine anisotropic permeability and the vertical reservoir structure according to known techniques, a multiprobe module F can be added to probe module E, as shown in FIG. 2. Multiprobe module F has sink probe assemblies 12 and 14.

The hydraulic power module C includes pump 16, reservoir 18, and motor 20 to control the operation of the pump 16. Low oil switch 22 also forms part of the control system and is used in regulating the operation of the pump 16.

The hydraulic fluid line 24 is connected to the discharge of the pump 16 and runs through hydraulic power module C and into adjacent modules for use as a hydraulic power source. In the embodiment shown in FIG. 2, the hydraulic fluid line 24 extends through the hydraulic power module C into the probe modules E and/or F depending upon which configuration is used. The hydraulic loop is closed by virtue of the hydraulic fluid return line 26, which in FIG. 2 extends from the probe module E back to the hydraulic power module C where it terminates at the reservoir 18.

The pump-out module M, seen in FIG. 3, can be used to dispose of unwanted samples by virtue of pumping fluid through the flow line 54 into the borehole, or may be used to pump fluids from the borehole into the flow line 54 to inflate the straddle packers 28 and 30. Furthermore, pump-out module M may be used to draw formation fluid from the wellbore via the probe module E or F, and then pump the formation fluid into the sample chamber module S against a buffer fluid therein. This process will be described further below.

The bi-directional piston pump 92, energized by hydraulic fluid from the pump 91, can be aligned to draw from the flow line 54 and dispose of the unwanted sample though flow line 95, or it may be aligned to pump fluid from the borehole (via flow line 95) to flow line 54. The pumpout module can also be configured where flowline 95 connects to the flowline 54 such that fluid may be drawn from the downstream portion of flowline 54 and pumped upstream or vice versa. The pump out module M has the necessary control devices to regulate the piston pump 92 and align the fluid line 54 with fluid line 95 to accomplish the pump out procedure. It should be noted here that piston pump 92 can be used to pump samples into the sample chamber module(s) S, including overpressuring such samples as desired, as well as to pump samples out of sample chamber module(s) S using the pump-out module M. The pump-out module M may also be used to accomplish constant pressure or constant rate injection if necessary. With sufficient power, the pump out module M may be used to inject fluid at high enough rates so as to enable creation of microfractures for stress measurement of the formation.

Alternatively, the straddle packers 28 and 30 shown in FIG. 2 can be inflated and deflated with borehole fluid using the piston pump 92. As can be readily seen, selective actuation of the pump-out module M to activate the piston pump 92, combined with selective operation of the control valve 96 and inflation and deflation of the valves I, can result in selective inflation or deflation of the packers 28 and 30. Packers 28 and 30 are mounted to outer periphery 32 of the apparatus A, and may be constructed of a resilient material compatible with wellbore fluids and temperatures. The packers 28 and 30 have a cavity therein. When the piston pump 92 is operational and the inflation valves I are properly set, fluid from the flow line 54 passes through the inflation/deflation valves I, and through the flow line 38 to the packers 28 and 30.

As also shown in FIG. 2, the probe module E has a probe assembly 10 that is selectively movable with respect to the apparatus A. Movement of the probe assembly 10 is initiated by operation of a probe actuator 40, which aligns the hydraulic flow lines 24 and 26 with the flow lines 42 and 44. The probe 46 is mounted to a frame 48, which is movable with respect to apparatus A, and the probe 46 is movable with respect to the frame 48. These relative movements are initiated by a controller 40 by directing fluid from the flow lines 24 and 26 selectively into the flow lines 42, 44, with the result being that the frame 48 is initially outwardly displaced into contact with the borehole wall (not shown). The extension of the frame 48 helps to steady the tool during use and brings the probe 46 adjacent the borehole wall. Since one objective is to obtain an accurate reading of pressure in the formation, which pressure is reflected at the probe 46, it is desirable to further insert the probe 46 through the built up mudcake and into contact with the formation. Thus, alignment of the hydraulic flow line 24 with the flow line 44 results in relative displacement of the probe 46 into the formation by relative motion of the probe 46 with respect to the frame 48. The operation of the probes 12 and 14 is similar to that of probe 10, and will not be described separately.

Having inflated the packers 28 and 30 and/or set the probe 10 and/or the probes 12 and 14, the fluid withdrawal testing of the formation can begin. The sample flow line 54 extends from the probe 46 in the probe module E down to the outer periphery 32 at a point between the packers 28 and 30 through the adjacent modules and into the sample modules S. The vertical probe 10 and the sink probes 12 and 14 thus entry of formation fluids into the sample flow line 54 via one or more of a resistivity measurement cell 56, a pressure measurement device 58, and a pretest mechanism 59, according to the desired configuration. Also, the flowline 64 allows entry of formation fluids into the sample flowline 54. When using the module E, or multiple modules E and F, the isolation valve 62 is mounted downstream of the resistivity sensor 56. In the closed position, the isolation valve 62 limits the internal flow line volume, improving the accuracy of dynamic measurements made by the pressure gauge 58. After initial pressure tests are made, the isolation valve 62 can be opened to allow flow into the other modules via the flowline 54.

When taking initial samples, there is a high prospect that the formation fluid initially obtained is contaminated with mud cake and filtrate. It is desirable to purge such contaminants from the sample flow stream prior to collecting sample(s). Accordingly, the pump-out module M is used to initially purge from the apparatus A specimens of formation fluid taken through the inlet 64 of the straddle packers 28, 30, or vertical probe 10, or sink probes 12 or 14 into the flow line 54.

The fluid analysis module D includes an optical fluid analyzer 99, which is particularly suited for the purpose of indicating where the fluid in flow line 54 is acceptable for collecting a high quality sample. The optical fluid analyzer 99 is equipped to discriminate between various oils, gas, and water. U.S. Pat. Nos. 4,994,671; 5,166,747; 5,939,717; and 5,956,132, as well as other known patents, all assigned to Schlumberger, describe the analyzer 99 in detail, and such description will not be repeated herein, but is incorporated by reference in its entirety.

While flushing out the contaminants from apparatus A, formation fluid can continue to flow through the sample flow line 54 which extends through adjacent modules such as the precision pressure module B, fluid analysis module D, pump out module M, flow control module N, and any number of sample chamber modules S that may be attached as shown in FIG. 3. Those skilled in the art will appreciate that by having a sample flow line 54 running the length of the various modules, multiple sample chamber modules S can be stacked without necessarily increasing the overall diameter of the tool. Alternatively, as explained below, a single sample module S may be equipped with a plurality of small diameter sample chambers, for example by locating such chambers side by side and equidistant from the axis of the sample module. The tool can therefore take more samples before having to be pulled to the surface and can be used in smaller bores.

Referring again to FIGS. 2 and 3, the flow control module N includes a flow sensor 66, a flow controller 68, piston 71, reservoirs 72, 73 and 74, and a selectively adjustable restriction device such as a valve 70. A predetermined sample size can be obtained at a specific flow rate by use of the equipment described above.

The sample chamber module S can then be employed to collect a sample of the fluid delivered via the flow line 54 and regulated by the flow control module N, which is beneficial but not necessary for fluid sampling. With reference first to the upper sample chamber module S in FIG. 3, a valve 80 is opened and the valves 62, 62A and 62B are held closed, thus directing the formation fluid in the flow line 54 into a sample collecting cavity 84C in the chamber 84 of sample chamber module S, after which the valve 80 is closed to isolate the sample. The chamber 84 has a sample collecting cavity 84C and a pressurization/buffer cavity 84*p*. The tool can then be moved to a different location and the process repeated. Additional samples taken can be stored in any number of additional sample chamber modules S that may be attached by suitable alignment of valves. For example, there are two sample chambers S illustrated in FIG. 3. After having filled the upper chamber by operation of shut-off valve 80, the next sample can be stored in the lowermost sample chamber module S by opening the shut-off valve 88 connected to the sample collection cavity 90C of the chamber 90. The chamber 90 has a sample collecting cavity 90C and a pressurization/buffer cavity 90*p*. It should be noted that each sample chamber module has its own control assembly, shown in FIG. 3 as 100 and 94. Any number of sample chamber modules S, or no sample chamber modules, can be used in particular configurations of the tool depending upon the nature of the test to be conducted. Also, the sample module S may be a multi-sample module that houses a plurality of sample chambers, as mentioned above.

It should also be noted that buffer fluid in the form of full-pressure wellbore fluid may be applied to the backsides of the pistons in chambers 84 and 90 to further control the pressure of the formation fluid being delivered to the sample modules S. For this purpose, the valves 81 and 83 are opened, and the piston pump 92 of the pump-out module M must pump the fluid in the flow line 54 to a pressure exceeding wellbore pressure. It has been discovered that this action has the effect of dampening or reducing the pressure pulse or "shock" experienced during drawdown. This low shock sampling method has been used to particular advantage in obtaining fluid samples from unconsolidated formations, plus it allows overpressuring of the sample fluid via piston pump 92.

It is known that various configurations of the apparatus A can be employed depending upon the objective to be accomplished. For basic sampling, the hydraulic power module C can be used in combination with the electric power module L, probe module E and multiple sample chamber modules S. For reservoir pressure determination, the hydraulic power module C can be used with the electric power module L, probe module E and precision pressure module B. For uncontaminated sampling at reservoir conditions, the hydraulic power module C can be used with the electric power module L, probe module E in conjunction with fluid analysis module D, pump-out module M and multiple sample chamber modules S. A simulated Drill Stem Test (DST) test can be run by combining the electric power module L with the packer module P, and the precision pressure module B and the sample chamber modules S. Other configurations are also possible and the makeup of such configurations also depends upon the objectives to be accomplished with the tool. The tool can be of unitary construction a well as modular, however, the modular construction allows greater flexibility and lower cost to users not requiring all attributes.

As mentioned above, the sample flow line 54 also extends through a precision pressure module B. The precision gauge 98 of module B may be mounted as close to probes 12, 14 or 46, and/or to inlet flowline 32, as possible to reduce internal flow line length which, due to fluid compressibility, may affect pressure measurement responsiveness. The precision gauge 98 is typically more sensitive than the strain gauge 58 for more accurate pressure measurements with respect to time. The gauge 98 is preferably a quartz pressure gauge that performs the pressure measurement through the temperature and pressure dependent frequency characteristics of a quartz crystal, which is known to be more accurate than the comparatively simple strain measurement that a strain gauge employs. Suitable valving of the control mechanisms can also be employed to stagger the operation of the gauge 98 and the gauge 58 to take advantage of their difference in sensitivities and abilities to tolerate pressure differentials.

The individual modules of the apparatus A are constructed so that they quickly connect to each other. Preferably, flush connections between the modules are used in lieu of male/female connections to avoid points where contaminants, common in a wellsite environment, may be trapped.

Flow control during sample collection allows different flow rates to be used. Flow control is useful in getting meaningful formation fluid samples as quickly as possible which minimizes the chance of binding the wireline and/or the tool because of mud oozing into the formation in high permeability situations. In low permeability situations, flow control is very helpful to prevent drawing formation fluid sample pressure below its bubble point or asphaltene precipitation point.

More particularly, the "low shock sampling" method described above is useful for reducing to a minimum the pressure drop in the formation fluid during drawdown so as to minimize the "shock" on the formation. By sampling at the smallest achievable pressure drop, the likelihood of keeping the formation fluid pressure above asphaltene precipitation point pressure as well as above bubble point pressure is also increased. In one method of achieving the objective of a minimum pressure drop, the sample chamber is maintained at wellbore hydrostatic pressure as described above, and the rate of drawing connate fluid into the tool is controlled by monitoring the tool's inlet flow line pressure via gauge 58 and adjusting the formation fluid flowrate via pump 92 and/or flow control module N to induce only the minimum drop in the monitored pressure that produces fluid flow from the formation. In this manner, the pressure drop is minimized through regulation of the formation fluid flowrate.

Turning now to FIGS. 4A–D, a sample module SM according to one illustrative embodiment of the present invention is illustrated schematically. The sample module includes a sample chamber 110 for receiving and storing pressurized formation fluid. The piston 112 is slidably disposed in the chamber 110 to define a sample collection cavity 110*c* and a pressurization/buffer cavity 110*p*, the cavities having variable volumes determined by movement of the piston 112 within the chamber 110. A first flowline 54 is provided for communicating fluid obtained from a subsurface formation (as described above in association with FIGS. 2 and 3) through a sample module SM. A second flowline 114 connects the first flowline 54 to the sample cavity 110*c*, and a third flowline 116 connects the sample cavity 110*c* to either the first flowline 54 or an outlet port (not shown) in the sample module SM.

A first seal valve 118 is disposed in the second flowline 114 for controlling the flow of fluid from the first flowline 54 to the sample cavity 110*c*. A second seal valve 120 is disposed in the third flowline 116 for controlling the flow of fluid out of the sample cavity 110*c*. Given this setup, any fluid preloaded in the "dead volume" defined by the sample cavity 110*c* and the portions of the flowlines 114 and 116 that are sealed off by the seal valves 118 and 120, respectively, may be flushed therefrom using the formation fluid in the first flowline 54 and the seal valves 118 and 120.

Figure 4D:
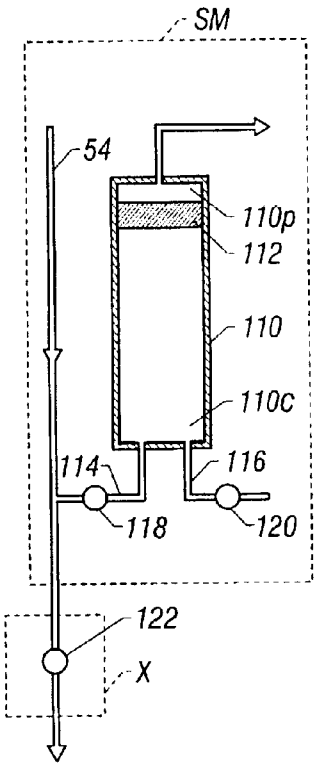
FIGS. 4A–D are sequential, schematic illustrations of a sample module incorporating dead volume flushing according to an embodiment of the present invention.
Figure 4C:
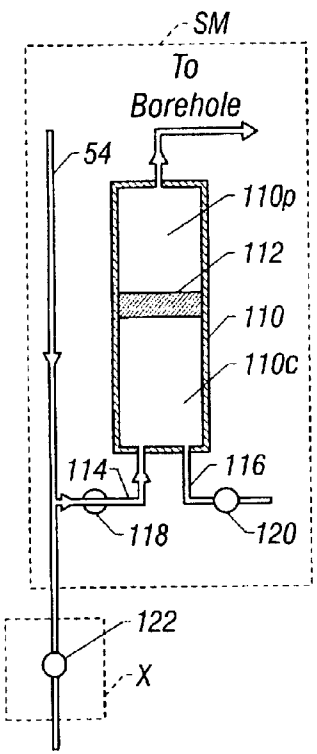
Figure 4B:
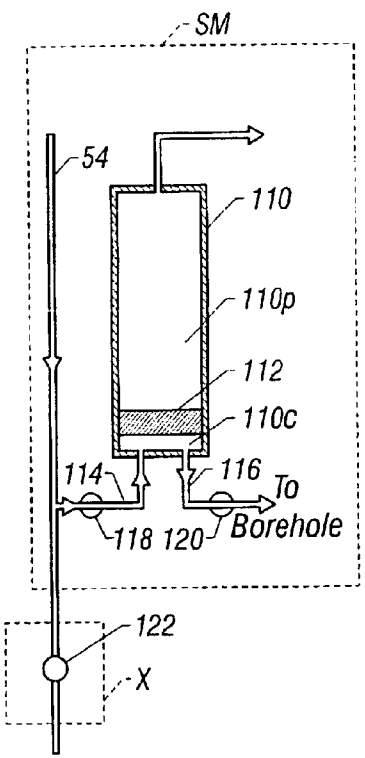
Figure 4A:
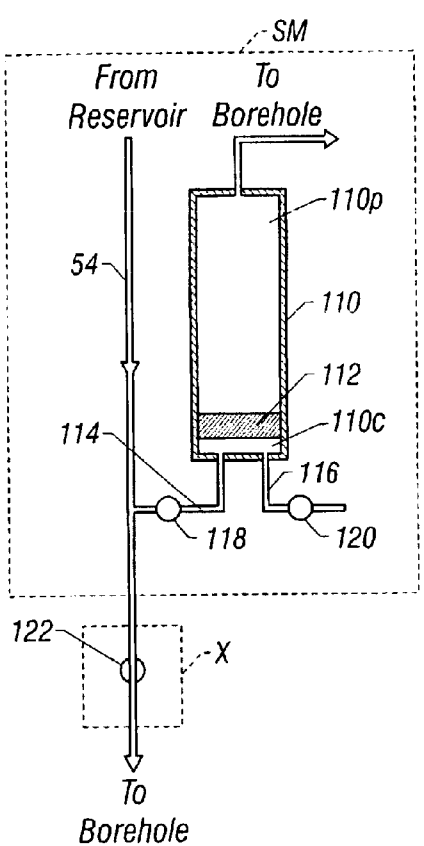

FIG. 4A shows that the valves 118 and 120 are both initially closed so that formation fluid being communicated via the above-described modules through the first flowline 54 of the tool A, including the portion of the first flowline 54 passing through the sample module SM, bypasses the sample chamber 110. This bypass operation permits contaminants in the newly-introduced formation fluid to be flushed through the tool A until the amount of contamination in the fluid has been reduced to an acceptable level. Such an operation is described above in association with the optical fluid analyzer 99.

Typically, a fluid such as water will fill the dead volume space between the seal valves 118 and 120 to minimize the pressure drop that the formation fluid experiences when the seal valves 118, 120 are opened. When it is desired to capture a sample of the formation fluid in the sample cavity 110*c* of the sample chamber 110, and the analyzer 99 indicates the fluid is substantially free of contaminants, the first step will be to flush the water (although other fluids may be used, water will be described hereinafter) out of the dead volume space. This is accomplished, as seen in FIG. 4B, by opening both seal valves 118 and 120 and blocking the first flowline 54 by closing the valve 122 within another module X of tool A. This action diverts the formation fluid "in" through first seal valve 118, through the sample cavity 110*c*, and "out" through the second seal valve 120 for delivery to the borehole. In this manner, any extraneous water disposed in the dead volume between the seal valves 118 and 120 will be flushed out with contaminant-free formation fluid.

After a short period of flushing, the second seal valve 120 is closed, as shown in FIG. 4C, causing formation fluid to fill the sample cavity 110*c*. As the sample cavity is filled, the buffer fluid present in the buffer/pressurization cavity 110*p* is displaced to the borehole by movement of the piston 112.

Once sample cavity 110*c* is adequately filled, the first seal valve 118 is closed to capture the formation fluid sample in the sample cavity. Because the buffer fluid in cavity 110*p* is in contact with the borehole in this embodiment of the present invention, the formation fluid must be raised to a pressure above hydrostatic pressure in order to move the piston 112 and fill the sample cavity 110*c*. This is the low shock sampling method described above. After piston 112 reaches it's maximum travel, the pump module M raises the pressure of the fluid in the sample cavity 110*c* to some desirable level above hydrostatic pressure prior to shutting the first seal valve 118, thereby capturing a sample of formation fluid at a pressure above hydrostatic pressure. This "captured" position is illustrated in FIG. 4D.

Figure 5B:
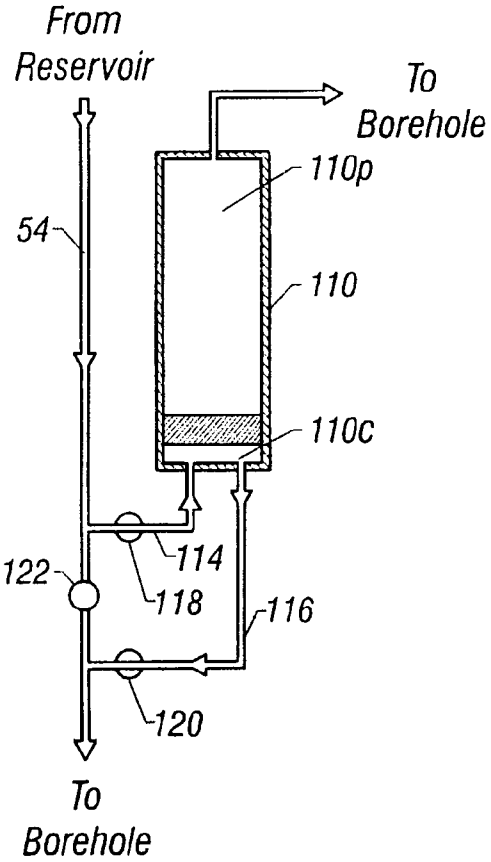
FIGS. 5A–B are schematic illustrations of sample modules according to an embodiment of the present invention having alternative flow orientations.
Figure 5A:
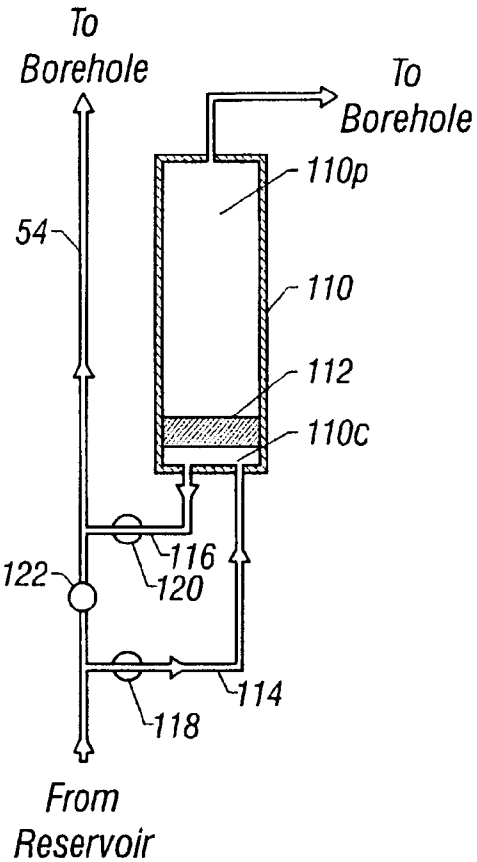

The various modules of tool A have the capability of being placed above or below the module (for example, module E, F, and/or P of FIG. 2) which engages the formation. This engagement occurs at a point known as the sampling point. FIGS. 5A–B depict structure for positioning the flowline shut-off valve 122 in the sample module SM itself while maintaining the ability to place the sample module above or below the sampling point. The shut-off valve 122 is used to divert the flow into the sample cavity 110*c* from a sampling point below the sample chamber 110 in FIG. 5A, and from a sampling point above the sample chamber 110 in FIG. 5B. Both figures show formation fluid being diverted from the first flowline 54 into the second flowline 114 via first seal valve 118. The fluid passes through sample cavity 110*c* and back to the first flowline 54 via the third flowline 116 and second seal valve 120. From there, the formation fluid in the flowline 54 may be delivered to other modules of the tool A or dumped to the borehole.

The embodiments of FIGS. 4A–D and 5A–B place the buffer fluid in the buffer cavity 110*p* in direct contact with the borehole fluid. Again, this results in the low shock method for sampling described above. Sample chamber 110 can also be configured such that no buffer fluid is present behind the piston, and only air fills the buffer cavity 110*p*. This would result in a standard air cushion sampling method. However, in order to use some of the other capabilities (described below) of the various modules of tool A, the buffer fluid in the buffer cavity 110*p* must be routed back to the flowline 54. Thus, air may not be desirable in these instances.

The present invention may be further equipped in certain embodiments, as shown in FIGS. 6A–D, with a fourth flowline 124 connected to the buffer cavity 110*p* of the sample chamber 110 for communicating buffer fluid into and out of the buffer cavity 110*p*. The fourth flowline 124 is also connected to the first flowline 54 downstream of the shut off valve 122, whereby the collection of a fluid sample in the sample cavity 110*c* will expel buffer fluid from the buffer cavity 110*p* into the first flowline 54 via the fourth flowline 124.

A fifth flowline 126 is connected to the fourth flowline 124 and to the first flowline 54, the latter connection being upstream of the connection between the first flowline 54 and the second flowline 114. The fourth flowline 124 and the fifth flowline 126 permit manipulation of the buffer fluid to create a pressure differential across the piston 112 for selectively drawing a fluid sample into the sample cavity 110*c*. This process will be explained further below with reference to FIGS. 7A–D.

Figures 6A, 6B, 6C, 6D:
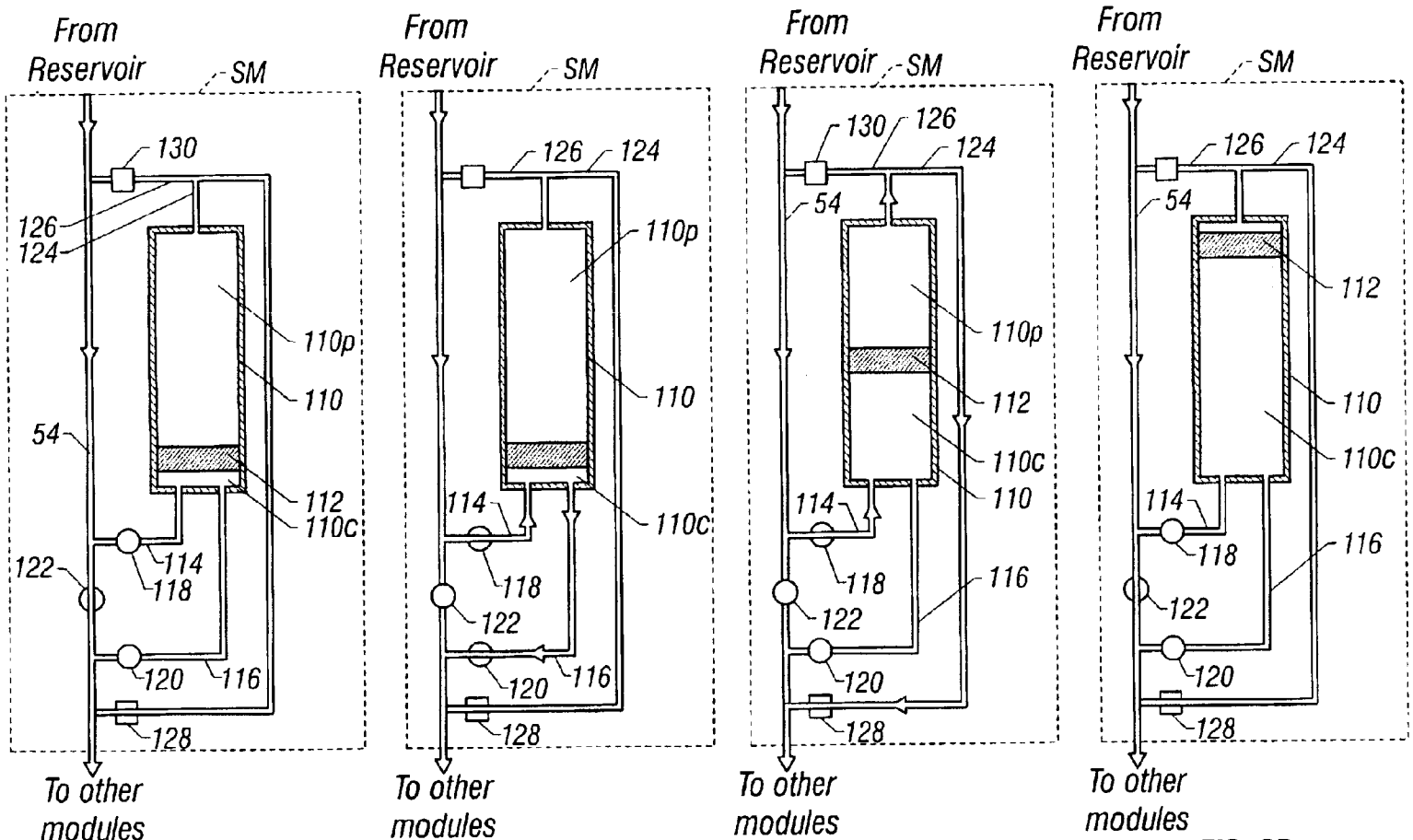
FIGS. 6A–D are sequential, schematic illustrations of a sample module according to an embodiment of the present invention wherein buffer fluid is expelled back into the primary flowline as a sample is collected in a sample chamber.

The buffer fluid is routed to the first flowline 54 both above the flowline seal valve 122 and below the flowline seal valve 122 via the flowlines 124 and 126. Depending on whether the formation fluid is flowing from top to bottom (as shown in FIGS. 6A–D) or bottom to top, one of the manual valves 128, 130 in the buffer fluid flowlines 124, 126, respectively, is opened and the other one shut. In FIGS. 6A–D, the flow is coming from the top of the sample module SM and flowing out the bottom of the sample module, so the top manual valve 130 is closed and the bottom manual valve 128 is opened. The sample module is initially configured with the first and second seal valves 118 and 120 closed and the flowline seal valve 122 open, as shown in FIG. 6A.

When a sample of formation fluid is desired, the first step again is to flush out the dead volume fluid between the fist and second seal valves 118 and 120. This step is shown in FIG. 6B, wherein the seal valves 118 and 120 are opened and the flowline seal valve 122 is closed. These valve settings divert the formation fluid through the sample cavity 110*c* and flush out the dead volume.

After a short period of flushing, the second seal valve 120 is closed as seen in FIG. 6C. The formation fluid then fills the sample cavity 110*c* and the buffer fluid in the buffer cavity 110*p* is displaced by the piston 112 into the flowline 54 via the fourth flowline 124 and the open manual valve 128. Because the buffer fluid is now flowing through the first flowline 54, it can communicate with other modules of the tool A. The flow control module N can be used to control the flow rate of the buffer fluid as it exits the sample chamber 110. Alternatively, by placing the pump module M below the sample module SM, it can be used to draw the buffer fluid out of the sample chamber, thereby reducing the pressure in the sample cavity 110*c* and drawing formation fluid into the sample cavity (described further below). Still further, a standard sample chamber with an air cushion can be used as the exit port for the buffer fluid in the event that the pump module fails. Also, the flowline 54 can communicate with the borehole, thereby reestablishing the above-described low shock sampling method.

Once the sample chamber 110*c* is filled and the piston 112 reaches its upper limiting position, as shown in FIG. 6D, the collected sample may be overpressured (as described above) before closing the first and second seal valves 118 and 120 and reopening the flowline seal valve 122.

The low shock sampling method has been established as a way to minimize the amount of pressure drop on the formation fluid when a sample of this fluid is collected. As stated above, the way this is normally done is to configure the sample chamber 110 so that borehole fluid at hydrostatic pressure is in direct communication with the piston 112 via the buffer cavity 110*p*. A pump of some sort, such as the piston pump 92 of pump module M, is used to reduce the pressure of the port which communicates with the reservoir, thereby inducing flow of the formation or formation fluid into the tool A. Pump module M is placed between the reservoir sampling point and the sample module SM. When it is desired to take a sample, the formation fluid is diverted into the sample chamber. Since the piston 112 of the sample chamber is being acted upon by hydrostatic pressure, the pump must increase the pressure of the formation fluid to at least hydrostatic pressure in order to fill the sample cavity 110*c*. After the sample cavity is full, the pump can be used to increase the pressure of the formation fluid even higher than hydrostatic pressure in order to mitigate the effects of pressure loss through cooling of the formation fluid when it is brought to surface.

Thus, in low shock sampling, the pump module M must lower the pressure at the reservoir interface and then raise the pressure at the pump discharge or outlet to at least hydrostatic pressure. The formation fluid, however, must pass through the pump module to accomplish this. This is a concern, because the pump module may have extra pressure drops associated with it that are not witnessed at the wellbore wall due to check valves, relief valves, porting, and the like. These extraneous pressure drops could have an adverse affect on the integrity of the sample, especially if the drawdown pressure is near the bubble point or asphaltene drop-out point of the formation fluid.

Figures 7A, 7B, 7C, 7D:
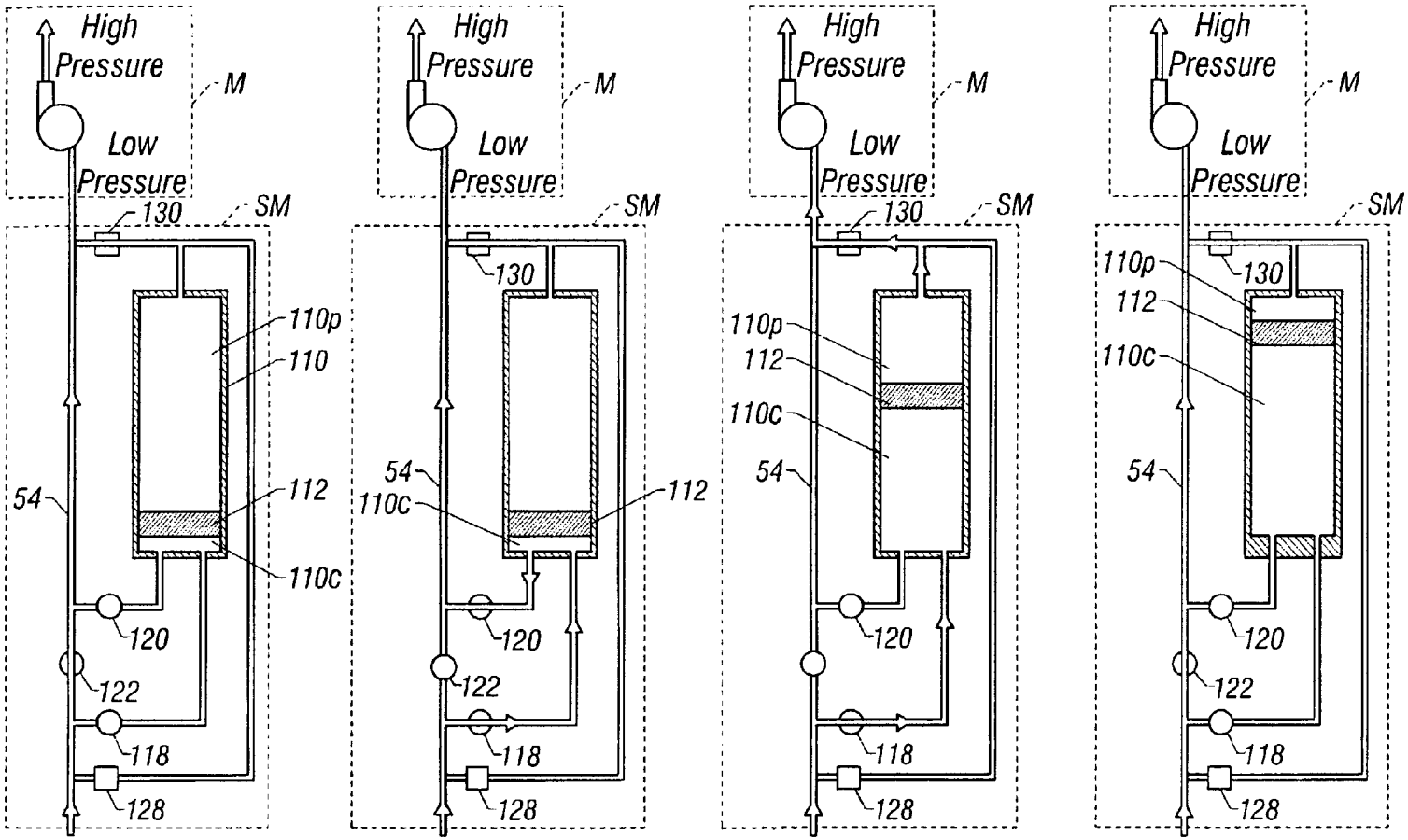
FIGS. 7A–D are sequential, schematic illustrations of a sample module according to an embodiment of the present invention wherein a pump is utilized to draw buffer fluid and thereby induce formation fluid into the sample chamber.

Because of these concerns, a new methodology for sampling that incorporates the advantages of the present invention is now proposed. This involves using the pump module M to reduce the pressure at the reservoir interface as described above. However, the sample module SM is placed between the sampling point and the pump module. FIGS. 7A–D depict this configuration. Pump module M is used to pump formation fluid through the tool A via the first flowline 54 and the open third seal valve 122, as shown in FIG. 7A, until it is determined that a sample is desired. Both the first seal valve 118 and the second seal valve 120 of the sample module SM are then opened and the third flowline seal valve 122 is closed, as illustrated by FIG. 7B. This causes the formation fluid in the flowline 54 to be diverted through the sample cavity 110*c* and flush out the dead volume liquid between the valves 118 and 120. After a short period of flushing, the second seal valve 120 is closed. Pump module M then has communication only with the buffer fluid in the buffer cavity 110*p*. The buffer fluid pressure is reduced via the pump module, whose outlet goes to the borehole at hydrostatic pressure. Since the buffer fluid pressure is reduced below reservoir pressure, the pressure in the sample cavity 110*c* behind the piston 112 is reduced, thereby drawing formation fluid into the sample cavity as shown in FIG. 7C. When the sample cavity 110*c* is full, the sample can be captured by closing the first seal valve 118 (seal valve 120 already being closed). The benefits of this method are that the formation fluid is not subjected to any extraneous pressure drops due to the pump module. Also, the pressure gauge which is located near the sampling point in the probe or packer module will indicate the actual pressure (plus/minus the hydrostatic head difference) at which the reservoir pressure enters the sample cavity 110*c*.

FIGS. 8A–D illustrate similar structure and methodology to that shown in FIGS. 7A–D, except the former figures illustrate a means to pressurize the buffer fluid cavity 110*p* with a pressurized gas to maintain the formation fluid in the sample cavity 110*c* above reservoir pressure. This eliminates the need/desire to overpressure the collected sample with the pump module, as described above. Two particular additions in this embodiment are an extra seal valve 132 in fourth flowline 124 controlling the exit of the buffer fluid from the buffer cavity 110*p*, and a gas charging module GM which includes a fifth seal valve 134 to control when pressurized fluid in cavity 140*c* of gas chamber 140 is communicated to the buffer fluid. The chamber 140 has a sample collecting cavity 140C and a pressurization/buffer cavity 140*p*.

Seal valve 132 on the buffer fluid can be used to ensure that the piston 112 in the sample chamber 110 does not move during the flushing of the sample cavity. In the embodiment of FIGS. 7A–D, there is no means to positively keep the piston 112 from moving. During dead volume flushing, the pressure in the sample cavity 110*c* is equal to the pressure in the buffer cavity 110*p* and therefore the piston 112 should not move due to the friction of the piston seals (not shown). To ensure that the piston does not move, it is desirable to have a positive method of locking in the buffer fluid such as the seal valve 132. Other alternatives are available, such as using a relief device with a low cracking pressure that would ensure that more pressure is needed to dispel the buffer fluid than to flush the dead volume. The seal valve 132 is also beneficial for capturing the buffer fluid after it has been charged by the nitrogen pressurized charge fluid in the cavity 140*c*.

Figure 8D:
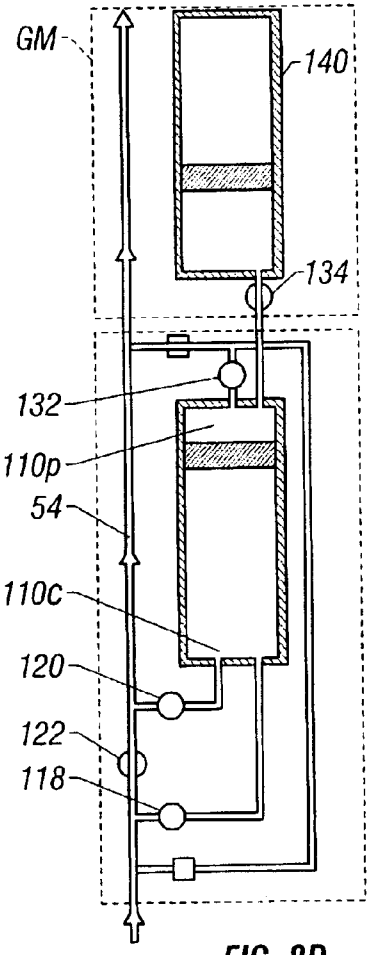
FIGS. 8A–D are sequential, schematic illustrations of a sample module according to an embodiment of the present invention equipped with a gas charge module.
Figure 8C:
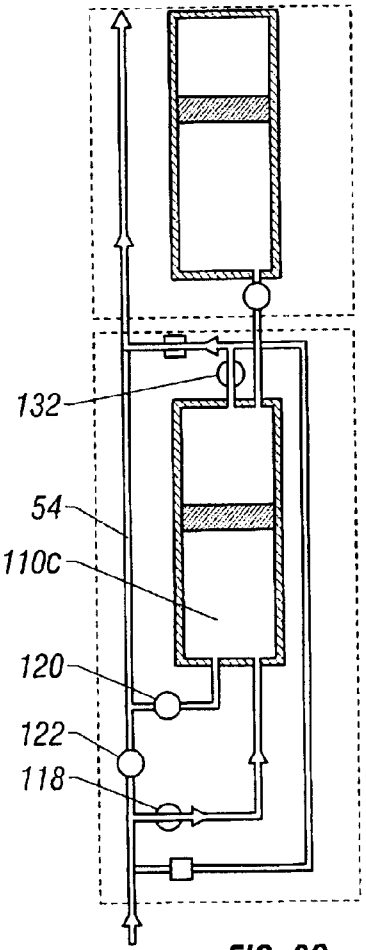
Figure 8B:
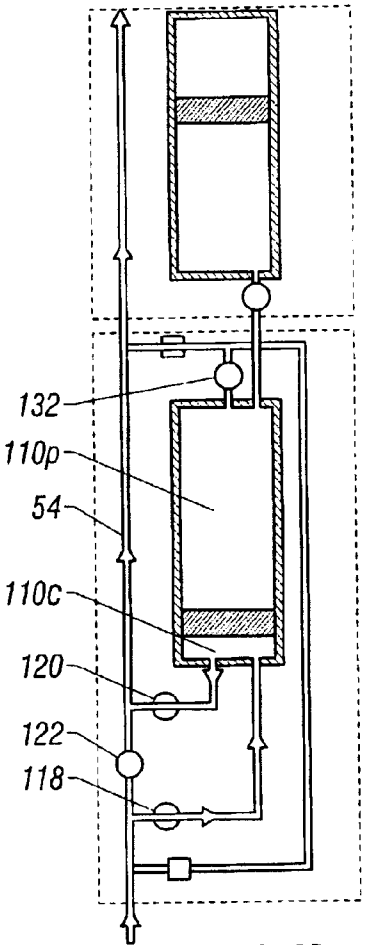
Figure 8A:
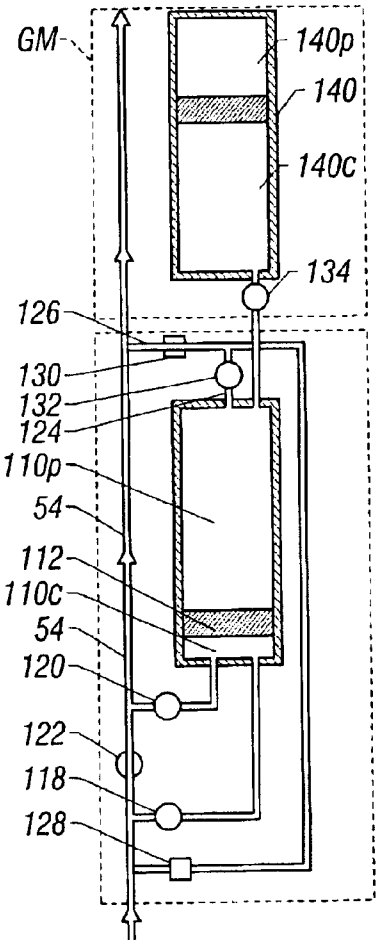

The method of sampling with the embodiment of FIGS. 8A–D is very similar to that described above for the other embodiments. While the formation fluid is being pumped through the flowline 54 across the various modules to minimize the contamination in the fluid, as seen in FIG. 8A, the third seal valve 122 is open while the first and second seal valves 118 and 120, along with the buffer seal valve 132 and charge module seal valve 134, are all closed. When a sample is desired, the first and second seal valves 118 and 120 are opened, the third, flowline seal valve 122 is closed, and the buffer fluid seal valve 132 remains closed. The formation fluid is thereby pumped through the sample cavity 110*c* to flush any water out of the dead volume space between the valves 118 and 120, which is shown in FIG. 8B. After a short period of flushing, the buffer seal valve 132 is opened, the second seal valve 120 is closed (first seal valve 118 remaining open), and the formation fluid begins to fill the sample cavity 110*c*, as seen in FIG. 8C.

Once the sample cavity 110*c* is full, the first seal valve 118 is closed, the buffer seal valve 132 is closed, and the third flowline seal valve 122 is opened so that pumping and flow through the flowline 54 can continue. To pressurize the formation fluid with gas charge module GM, the fifth seal valve 134 is opened thereby communicating the charge fluid to the buffer cavity 110*p*. Valve 134 remains open as the tool is brought to the surface, thereby maintaining the formation fluid at a higher pressure in the sample cavity 110*c* even as the sample chamber 110 cools. An alternative tool and method to using a fifth seal valve 134 to actuate the charge fluid in the gas module GM has been developed by Oilphase, a division of Schlumberger, and is described in U.S. Pat. No. 5,337,822, which is incorporated herein by reference. In this tool and method, through valving within the sample chamber of bottle 110 itself closes off the buffer and sampling ports and then opens a port to the charge fluid, thereby pressurizing the sample.

Even if there is no gas charge module present in the embodiment illustrated in FIGS. 8A–D, the alternative low shock sampling method described above and depicted in FIGS. 7A–D can still be used. Also, because there is a seal valve 132, which captures the buffer fluid after the formation fluid has been captured in the sample cavity 110*c*, the pump module M can be reversed to pump in the other direction. In other words, the pump module can be utilized to pressurize the buffer fluid in the buffer cavity 110*p*, which acts on the piston 112, and thereby pressurize the formation fluid captured in the sample cavity 110*c*. In essence, this process will duplicate the standard low shock method described above. The fourth seal valve 132 on the buffer fluid can then be closed to capture the appropriately pressurized sample.

Figure 9D:
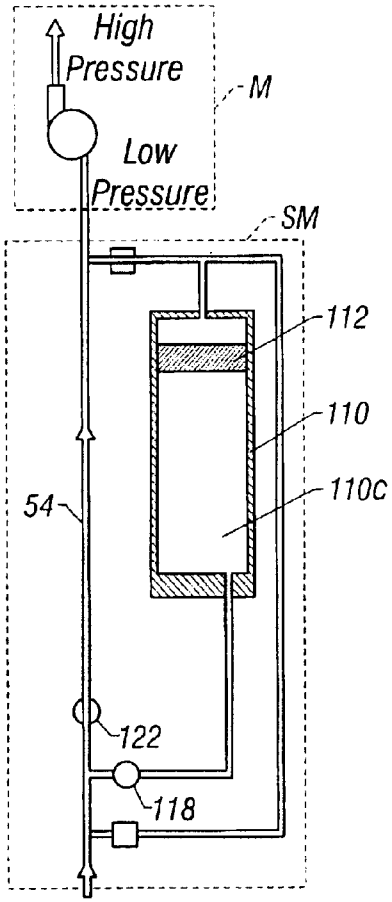
FIGS. 9A–D are sequential, schematic illustrations of a sample module according to an embodiment of the present invention wherein a pump is utilized to draw buffer fluid and thereby induce formation fluid into the sample chamber.
Figure 9C:
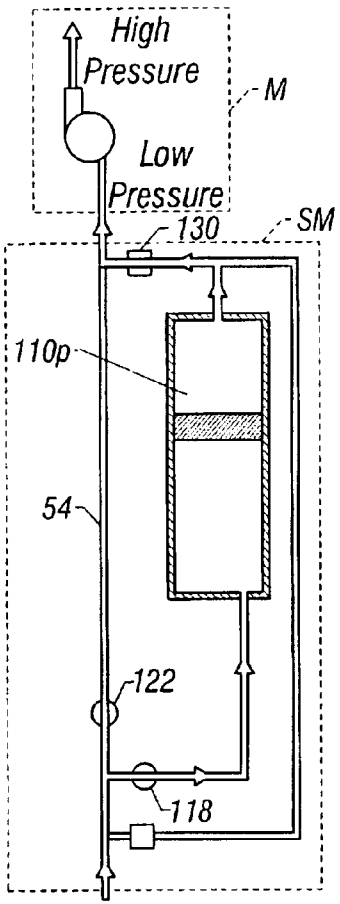
Figure 9B:
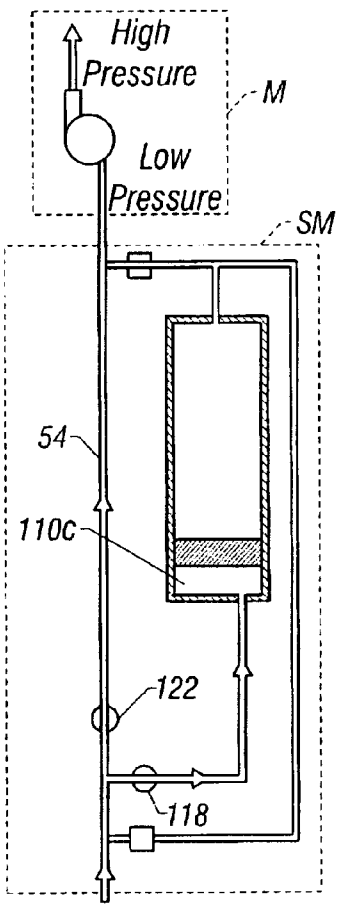
Figure 9A:
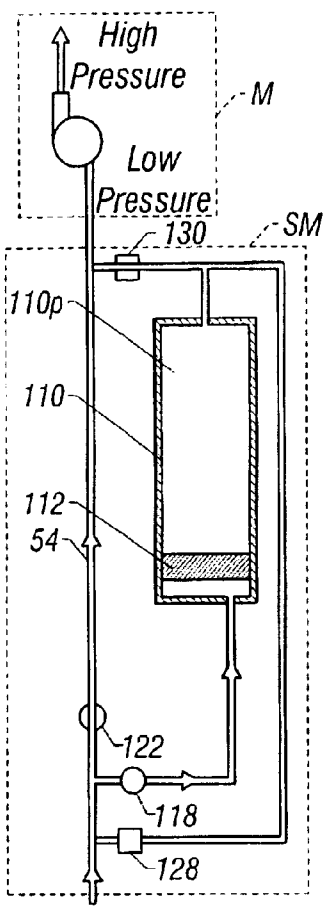

FIGS. 9A–D illustrate an alternative embodiment of the present invention having the sample module SM located between the sampling point and the pump module M. Pump module M is used to pump formation fluid through tool A via the flowline 54 and the open seal valve 122, as shown in FIG. 9A, until it is determined that a sample is desired. In the buffer fluid flowline 126, the manual valve 130 is open and the manual valve 128 is closed.

When a sample is desired, the seal valve 118 of the sample module SM is opened as illustrated by FIG. 9B. This causes a portion of the formation fluid in flowline 54 to be diverted through the seal valve 118 and into the sample cavity 110*c*. There is typically a check valve mechanism (not shown) located on the outlet of the buffer cavity 110*p* in the various embodiments of the present invention. To provide direct communication between the flowline 54 and the fluid in the buffer cavity 110*p*, the check mechanism should be removed. With the check mechanism removed, the pressure in the flowline 54 will be approximately equal with the pressure within the buffer cavity 110*p* of the sample chamber 110.

The terms "equalize", "equivalent pressure", "approximately equivalent pressure" and other like terms within the present application are used to describe relative pressures between two locations within a flowline or an apparatus. It is well known that fluid flows will be subject to frictional pressure losses while flowing unrestricted through a flowline, these ordinary and slight pressure differences are not considered significant within the scope of this application. Therefore within this application, two locations in a system that are in fluid communication with each other and are capable of unrestricted fluid movement between the two locations will be considered to be of equivalent pressure to each other. In some embodiments of the present invention an equivalent pressure between the sample cavity 110*c* and the buffer cavity 110*p* is one that has a differential pressure of less than 50 psi. In other embodiments of the present invention an equivalent pressure between the sample cavity 110*c* and the buffer cavity 110*p* is one that has a differential pressure of less than 25 psi. In yet another embodiment of the present invention an equivalent pressure between the sample cavity 110*c* and the buffer cavity 110*p* is one that has a differential pressure of less than 10 psi. In still other embodiments of the present invention an equivalent pressure between the sample cavity 110*c* and the buffer cavity 110*p* is one that has a differential pressure of less than 5 psi. In yet other embodiments of the present invention an equivalent pressure between the sample cavity 110*c* and the buffer cavity 110*p* is one that has a differential pressure of less than 2 psi.

The pump module M then has communication with the buffer fluid in the buffer cavity 110*p* in addition to the fluid within the flowline 54. Since the manual valve 130 is open, the buffer fluid within the buffer cavity 110*p* will have the approximately equivalent pressure as the fluid within the flowline 54. The buffer fluid can then be removed from buffer cavity 110*p* via the pump module M, whose outlet returns to the borehole at the hydrostatic pressure of the well. As fluid is removed from the buffer cavity 110*p*, the piston 112 will move, thereby drawing formation fluid into the sample cavity 110*c* as shown in FIG. 9C.

Since the seal valve 118 and the manual valve 130 remain in an open position, the pressure within the sample chamber 110 remains approximately equal to the flowline 54 pressure during the pumpout and the sampling operations. There can be a differential pressure across the open seal valve 122 resulting from the flow of fluids in the flowline 54 passing through the restriction of the open or partially open seal valve 112. This differential pressure can provide a driving force for fluid to enter the sample cavity 110*c*, while the sample cavity 110*c* and the buffer cavity 110*p* remain at approximately equivalent pressures. This provides a low shock sampling method that has the added benefit that the sample fluid does not need to pass through the pump module M prior to isolation within the sample chamber 110.

When the sample cavity 110*c* is full, the closing of seal valve 118, as shown in FIG. 9D, can capture the sample fluid. Once the seal valve 118 has been closed, the flow of fluids through the flowline 54 and through the pump module M can either be stopped, or can be continued if additional sample or testing modules require the flow of reservoir fluids.

FIGS. 10A–D depicts an alternate embodiment of the present invention having the sample module SM located between the sampling point and the pump module M. This embodiment is similar to the embodiment shown in FIGS. 9A–D, but has the added feature of an additional flowline and valve 120 providing fluid communication between the sample cavity 110*c* and the flowline 54, connecting to flowline 54 at a location downstream of the valve 122.

Figure 10D:
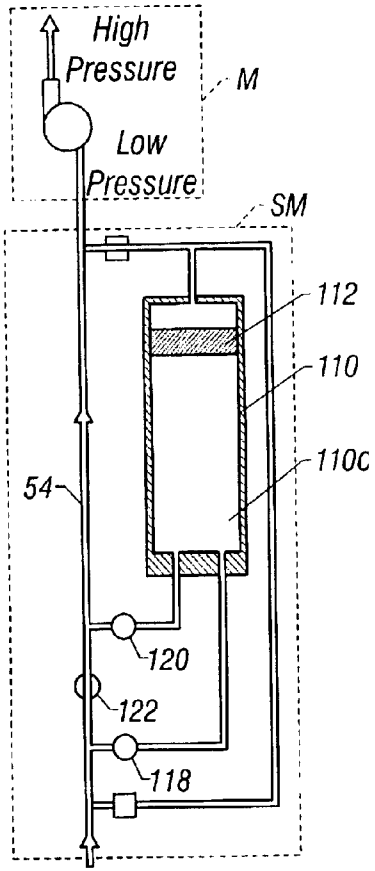
FIGS. 10A–D are sequential, schematic illustrations of a sample module according to an embodiment of the present invention wherein a pump is utilized to draw buffer fluid and thereby induce formation fluid into the sample chamber.
Figure 10C:
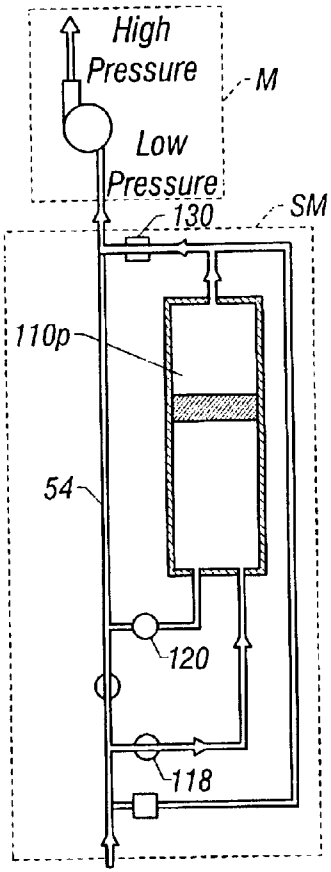
Figure 10B:
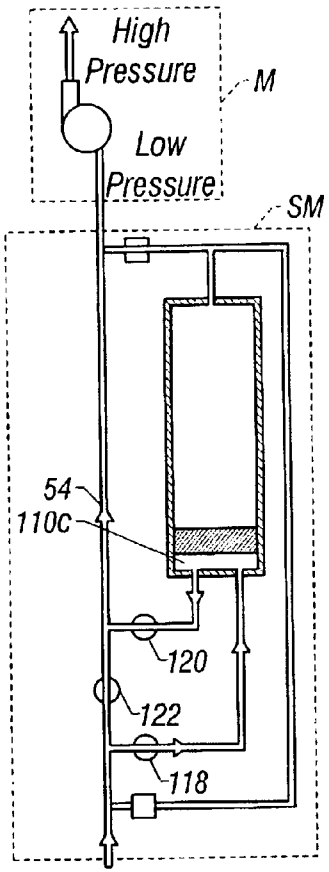
Figure 10A:
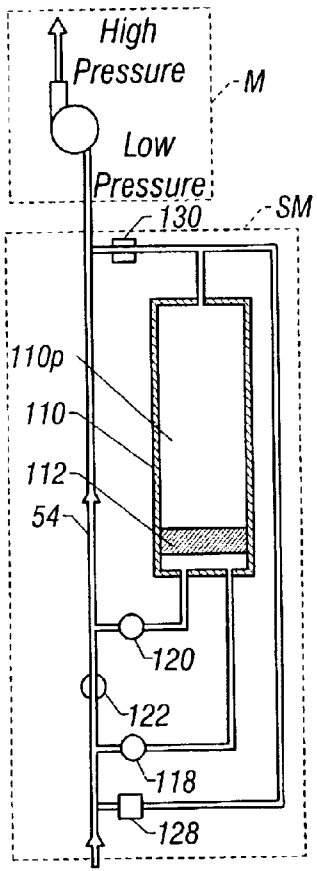

Pump module M is used to pump formation fluid through the tool A via the flowline 54 and the open seal valve 122 as shown in FIG. 10A, until it is determined that a sample is desired. In the buffer fluid flowline 126, the manual valve 130 is open and the manual valve 128 is closed. Both seal valve 118 and seal valve 120 of the sample module SM are then opened while the seal valve 122 remains in its open position, as illustrated by FIG. 10B. This causes a portion of the formation fluid in the flowline 54 to be diverted through the sample cavity 110*c* and flush out the dead volume liquid between the valves 118 and 120. After a short period of flushing, the seal valve 120 is closed. Pump module M then has communication with fluid in the flowline 54 and with the buffer fluid in the buffer cavity 110*p*. The buffer fluid is then removed from the buffer cavity 110*p* via the pump module, whose outlet returns to the borehole at hydrostatic pressure. The removal of the buffer fluid from the buffer cavity 110*p* causes the piston 112 to move toward the buffer end of the sample chamber 110, thereby drawing formation fluid into the sample cavity as shown in FIG. 10C. When the sample cavity 110*c* is full, the sample can be captured by closing the seal valve 118 (seal valve 120 already being closed), as shown in FIG. 10D. The fluid sample, being in fluid communication with the flowline 54, will have the same pressure during pumpout and sampling, thereby providing low shock sampling. Some of the benefits of this method are that the formation fluid is not subjected to any extraneous pressure drops due to flow through the pump module, or any possible contamination due to impurities within the pump module. Also, the pressure gauge, which is located near the sampling point in the probe or packer module, will indicate the actual pressure (plus/minus the hydrostatic head difference) at which the reservoir pressure enters the sample cavity 110*c*.

Referring to FIGS. 11A through 20B, additional embodiments of the present invention are illustrated. In each of the embodiments, one or more sample chambers are fluidly connected to main flowline 54 via one or more flowlines as previously described with respect to the embodiments of FIGS. 4A–10D. A shut off valve 122 is positioned along flowline 54, and can be opened or closed for either allowing or prohibiting the formation fluid to flow through the main flowline 54. The valve 122 defines a first portion of the main flowline fluidly connected to the formation, and a second portion of the main flowline fluidly connected to other portions of the tool. The second portion may also be fluidly connected to other modules, or provide a fluid path to discharge fluid to the borehole.

FIGS. 11A–15C depict an embodiment of the sampling apparatus having multiple sample chambers for use in the downhole tool. In each of the embodiments, one or more sample chambers are fluidly connected to flowline 54 multiple flowlines, at least one of which is shared by the sample chambers. The multiple sample chambers may be positioned, for example, in the same location within the downhole tool, in one or more sample modules within the downhole tool and/or used in place of the single sample chambers 84*p* or 90*p* in the MDT tool of FIG. 3. In each of these FIGS., the sampling point is depicted as being below the sample chambers. However it will be appreciated that the sampling point could be reversed and positioned above the sampling chambers by reversing the location of the corresponding flowlines.

Referring to FIGS. 11A–D, another embodiment of the present invention is illustrated. In this embodiment, multiple sample chambers 214, 216 and 218 are depicted as being connected to main flowline 54 in series by flowlines 222, 226, 228 and 220. This permits the simultaneous flushing of the sample chambers 214, 216 and 218, and the consecutive sampling of one or more of the sample chambers 214, 216 and 218.

The flowline 222 fluidly connects sample cavity 214*c* of sample chamber 214 to flowline 54. Flowline 226 fluidly connects sample cavity 214*c* to sample cavity 216*c* of sample chamber 216. Flowline 228 fluidly connects sample cavity 216*c* to sample cavity 218*c* of sample chamber 218. Flowline 220 fluidly connects sample cavity 218*c* back to flowline 54 thereby completing the circuit. Seal valves 122, 224, and 230 are positioned in flowlines 54, 222 and 220, respectively for selectively allowing fluid to flow therethrough. The sample chambers 214, 216 and 218 each have a piston 214*a*, 216*a* and 218*a* which separate the buffer fluid cavities 214*b*, 216*b* and 218*b* from a sample cavities 214*c*, 216*c* and 218*c*, respectively.

Figure 11A:
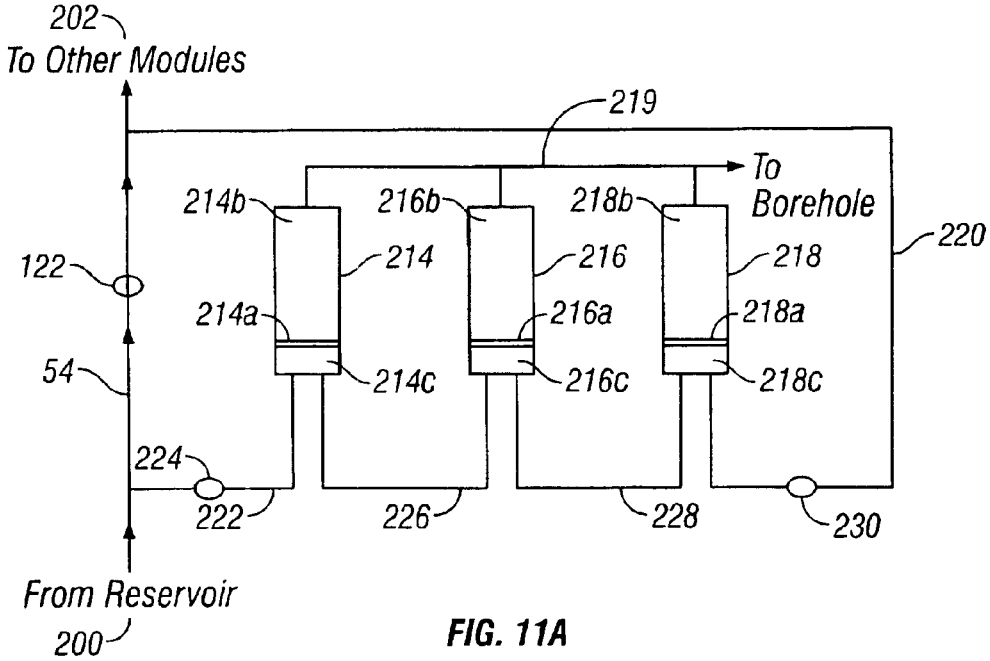
FIGS. 11A–11D are sequential, schematic illustrations of multiple sample chambers connected in series and having flowlines connecting the sample cavities of the sample chambers in series to a main flowline of a downhole sampling tool at a position above a sampling point of a reservoir according to an embodiment of the present invention.

FIG. 11A depicts the flow of fluid through the tool prior to sampling. Valve 122 is open, and valves 224 and 230 are closed. In this position, formation fluid flows from the reservoir 200, through the main flowline 54 and out to other modules 202.

Figure 11B:
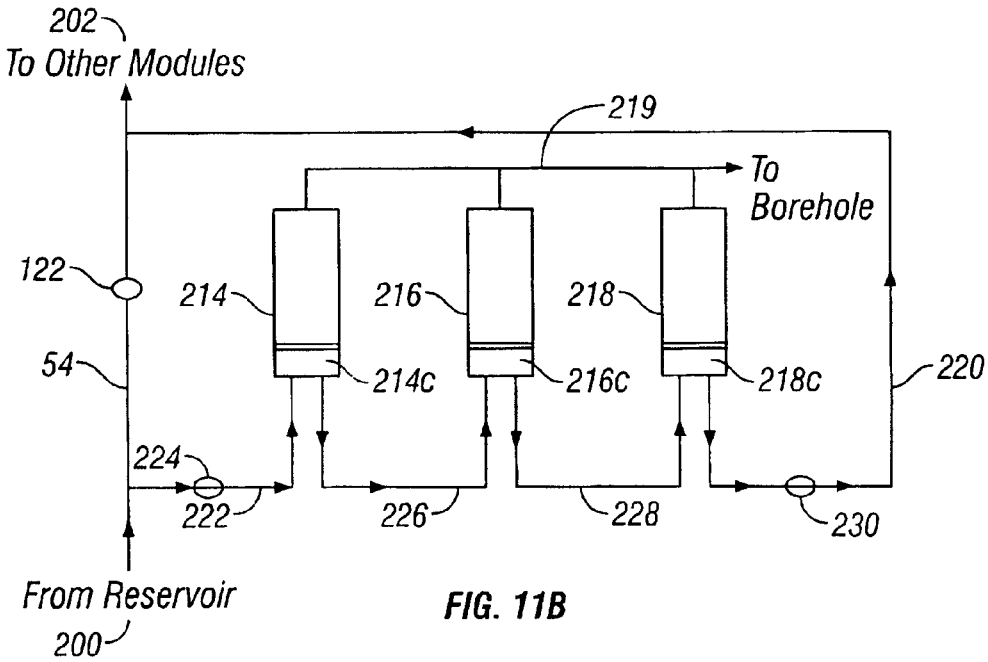

FIG. 11B depicts a dead volume flushing operation for flushing out contaminants in the flowlines 222, 226, 228 and 230 and sample cavities 214*c*, 216*c* and 218*c* of the sample chambers 214, 216 and 218. In this condition, the formation fluid flows from reservoir 200, into the flowline 222 at a point between closed valve 122 and reservoir 200, into the sample cavity 214*c* of the first sample chamber 214, into flowline 226, into the sample cavity 216*c* of the second sample chamber 216, into flowline 228, into the sample cavity 218*c* of the third sample chamber 218, into flowline 220, back to flowline 54 at a point between closed valve 122 and the other modules and out to other modules 202.

Figure 11C:
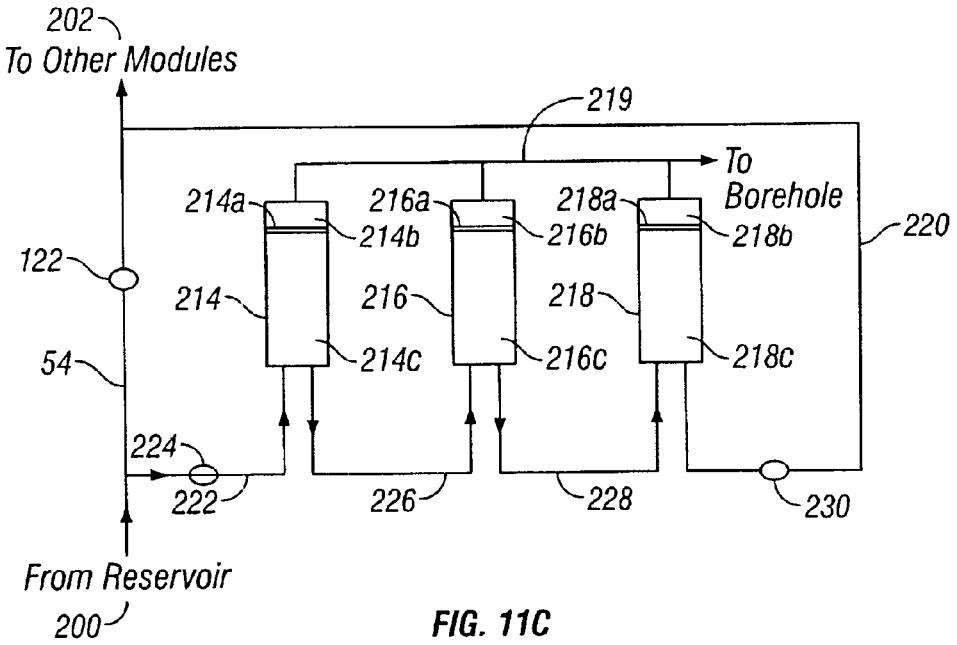

FIG. 11C depicts the sampling operation. Valves 122 and 230 are closed, and valve 224 is open. In this condition, the formation fluid flows from the reservoir 200, through the main flowline 54, into flowline 222 at a position below closed valve 122, into the sample cavity 214*c* of the first sample chamber 214, into flowline 226, into the sample cavity 216*c* of the second sample chamber 216, into flowline 228, and into the sample cavity 218*c* of sample chamber 218. As the pressure of the formation fluid in the flowlines 222, 226, 228 and in the sample cavities 214*c*, 216*c*, 218*c* increases, pistons 214*a*, 216*a*, 218*a* in sample chambers 214–218 move upwardly thereby drawing a sample of the formation fluid into the sample cavities 214*c*–218*c* and expelling buffer fluid from the buffer cavities 214*b*, 216*b*, 218*b* out through flowline 219 to the borehole. As shown in FIG. 11C, all three sample chambers are filled. Optionally, valves may be provided in flowlines 226 and 228 to allow sampling in sample chamber 214 and/or 216 without filling sample chamber 218.

Figure 11D:
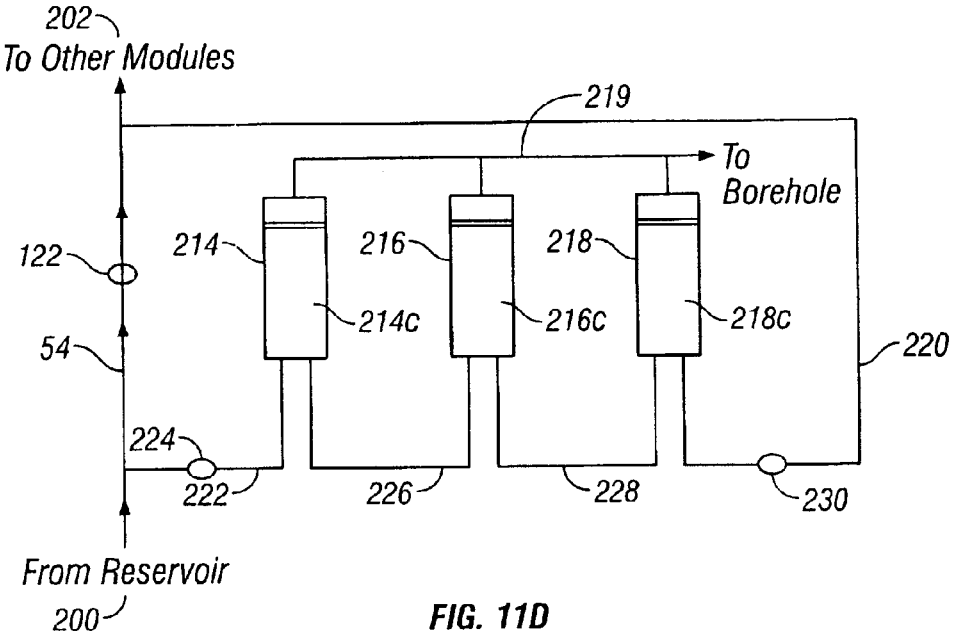

FIG. 11D depicts the flow of fluid in the downhole tool after sampling is complete. Valves 224 and 230 are closed, and valve 122 is open. In this position, the formation fluid flows from the reservoir 200 through the main flowline 54, and out to the other modules 202. At this point, one or more of the sample cavities is full and may either be removed for testing, or emptied for further sampling. The process may be repeated for multiple samples.

Referring to FIGS. 12A–12D, another embodiment of the present invention is illustrated. In this embodiment, multiple sample chambers 232, 234 and 236 are depicted as being fluidly connected in parallel to flowlines 54 and 244. This permits the simultaneous flushing and filling of the sample chambers. In this embodiment, the sample chambers are depicted as being positioned above the sampling point.

The flowlines 238, 246 and 252 fluidly connect sample cavities 232*c*, 234*c* and 236*c* of sample chamber 232, 234 and 236, respectively, to flowline 54 at a position between valve 122 and the reservoir 200. Flowlines 242, 250 and 256 fluidly connect sample cavities 232*c*, 234*c* and 236*c* of sample chamber 232, 234 and 236, respectively, to flowline 245. Flowline 245 is fluidly connected to flowline 54 at a position between valve 122 and the other modules 202. Valves 122 and 244 are positioned in flowlines 54 and 245, respectively for selectively allowing fluid to flow therethrough. Valves 240, 248 and 254 are positioned in flowlines 238, 246 and 252, respectively, for selectively allowing fluid to flow therethrough. The sample chambers 232, 234 and 236 each have a piston 232*a*, 234*a* and 236*a* which separate the buffer fluid cavity 232*b*, 234*b* and 236*b* from a sample cavity 232*c*, 234*c* and 236*c*, respectively.

Figure 12A:
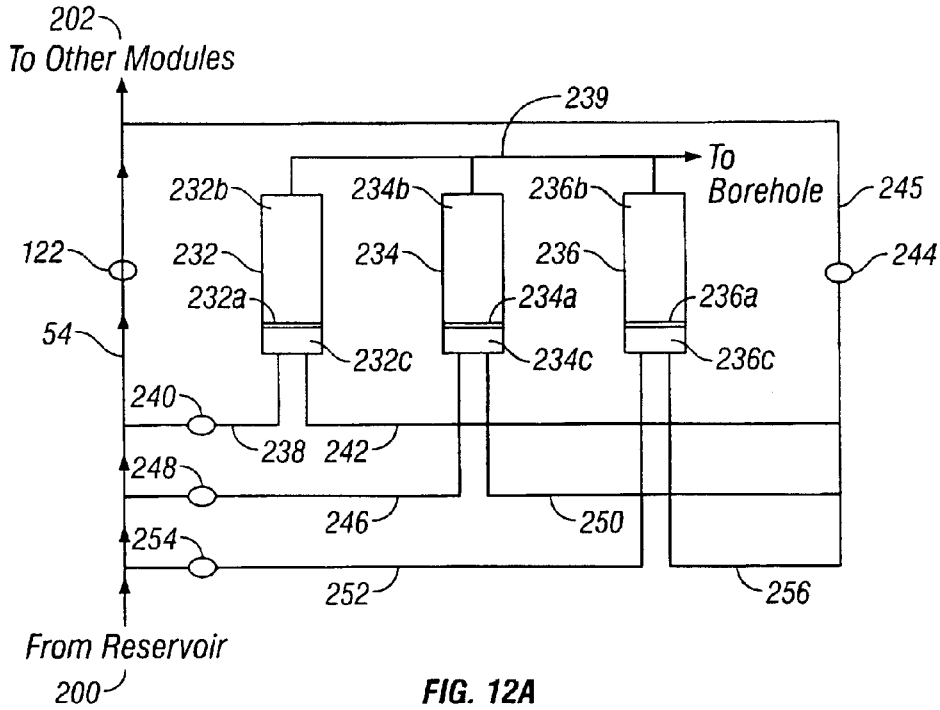
FIGS. 12A–D are sequential, schematic illustrations of multiple sample chambers connected in parallel, each sample chamber having a first flowline selectively connected to a main flowline and a second flowline selectively connected via a third flowline to the main flowline of a downhole sampling tool at a position above a sampling point of a reservoir according to an embodiment of the present invention.

FIG. 12A depicts the flow of fluid through the tool prior to sampling. Valve 122 is open, and valves 240, 248, 254 and 244 are closed. In this position, formation fluid flows from the reservoir 200, through the main flowline 54, and out to the other modules 202.

Figure 12B:
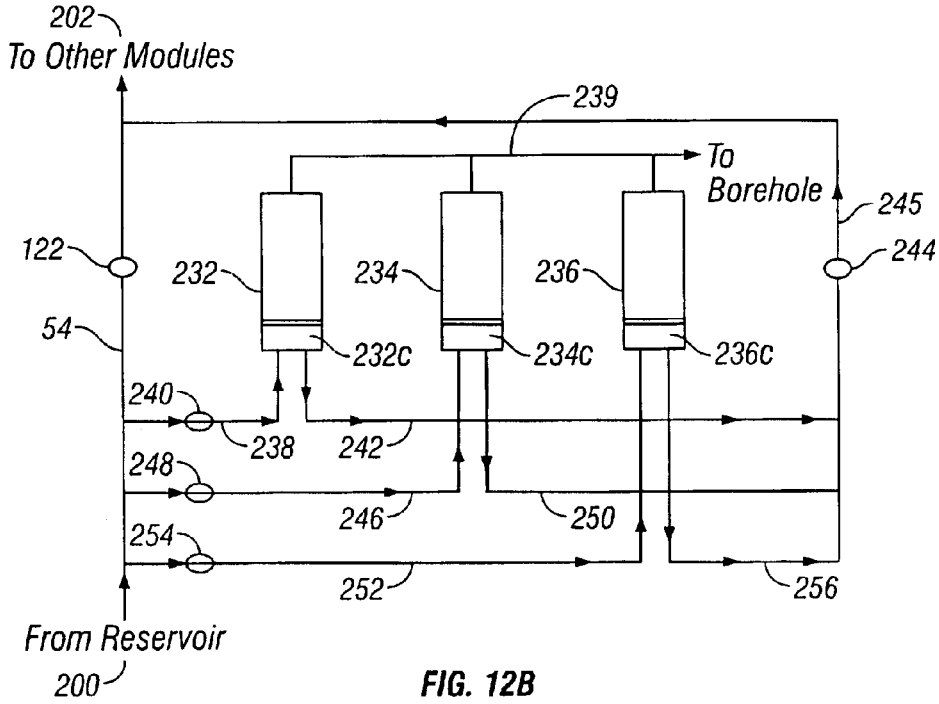

FIG. 12B depicts a dead volume flushing operation for flushing out contaminants in the flowlines 238, 246, 252, 242, 250, 256 and 245 and sample cavities 232*c*, and 236*c* of the corresponding sample chamber 232, 234 and 236. In this condition, the formation fluid flowing from reservoir 200, through flowline 54, into the flowlines 238, 246, 252 at a position between closed valve 122 and reservoir 200, through the sample cavities 232*c*, 234*c*, 236*c* of the three sample chambers 232–236, through the flowlines 242, 250, 256, through flowline 245, and back to flowline 54 at a position between closed valve 122 and the other modules, and out to the other modules 202.

Figure 12C:
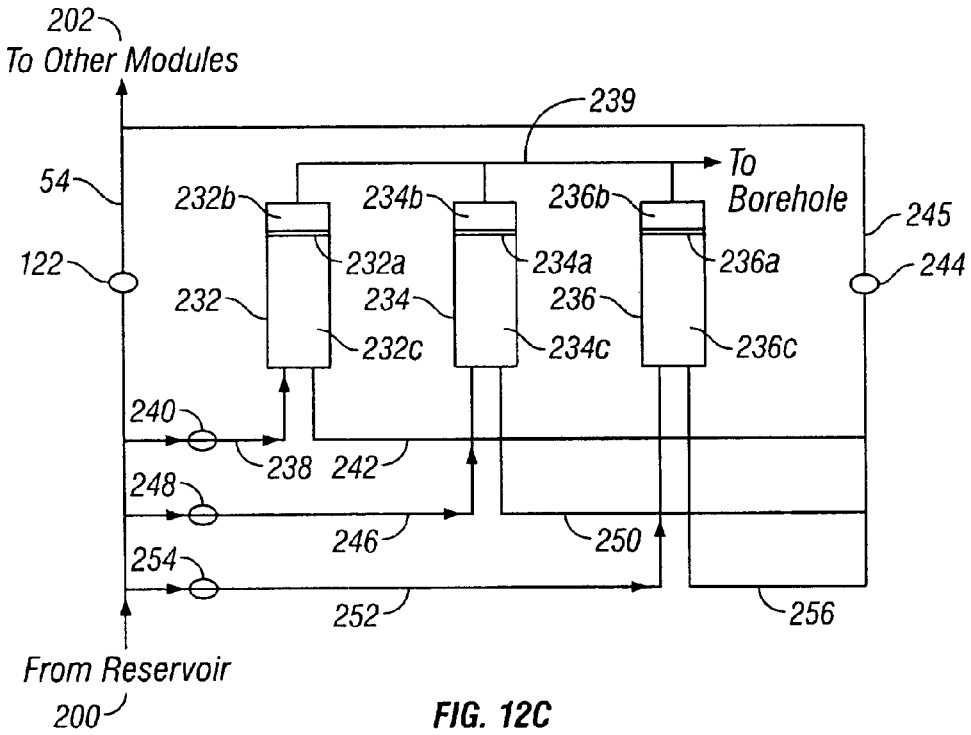

FIG. 12C depicts the sampling operation. Valve 122 and 244 are closed and valves 240, 248 and 254 are open. In this condition, the formation fluid flows from the reservoir 200, through the main flowline 54, into flowlines 238, 248 and 254 at a position between closed valve 122 and the reservoir, into the sample cavities 232*c*, 234*c* and 236*c* of the first sample chamber 232, 234 and 236, into flowlines 242, 250 and 256, into flowline 245, back to flowline 54 at a position between closed valve 122 and the other modules, and out to other modules. As the pressure of the formation fluid in the flowlines 238, 246, and 252 and in the sample cavities 232*c*, 234*c* and 236*c* increases, pistons 232*a*, 234*a* and 236*a* in sample chambers 232–236 move upwardly thereby drawing a sample of the formation fluid into the sample cavities 232*c*, 234*c*, and 236*c* and expelling buffer fluid from the buffer cavities 232*b*, 234*b*, 236*b* out through flowline 239 to the borehole.

Figure 12D:
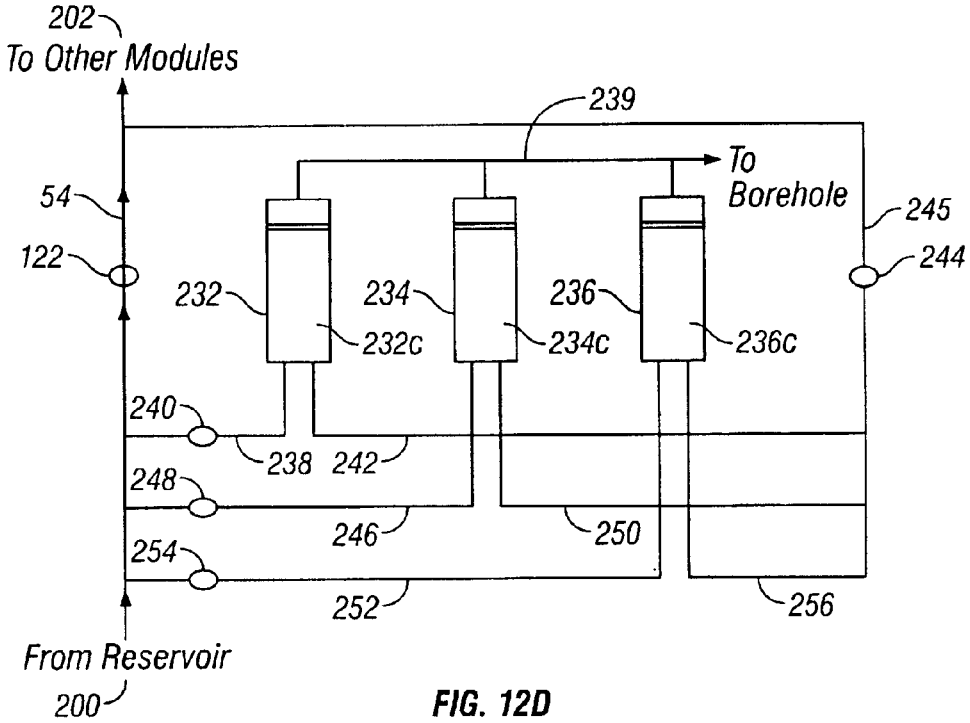

FIG. 12D depicts the flow of fluid in the downhole tool after sampling is complete. Valves 240, 248, 254 and 244 are closed, and the main flowline seal valve 122 is open. In this position, the formation fluid flows from the reservoir into the main flowline 54, and up to the other modules 202. At this point, the sample cavities are at least partially full and may either be removed for testing, or emptied for further sampling. The process may be repeated for multiple samples.

Referring to FIGS. 13A–14C, another embodiment of the present invention is illustrated. In this embodiment, multiple sample chambers 260, 262 and 264 are depicted as being connected in parallel to flowlines 54 and 290. This permits the selective flushing and/or sampling of one or more sample chambers 214, 216 and 218.

The flowlines 278, 282 and 286 fluidly connect sample cavities 260*c*, 262*c* and 264*c* of sample chamber 260, 262 and 264, respectively, to flowline 54. Flowlines 280, 284 and 288 fluidly connect sample cavities 260*c*, 262*c* and 264*c* of sample chamber 260, 262 and 264, respectively, to flowline 290. Valves 266, 268 and 270 are positioned in flowlines 278, 268 and 270, respectively, for selectively allowing fluid to flow therethrough. Valves 272, 274 and 276 are positioned in flowlines 280, 284 and 288, respectively, for selectively allowing fluid to flow therethrough. The sample chambers 260, 262 and 264 each have a piston 260*a*, 262*a* and 264*a* which separate a buffer fluid cavity 260*b*, 262*b* and 264*b* from a sample cavity 260*c*, 262*c* and 264*c*, respectively. Flowline 289 fluidly connects buffer chambers 260*b*, 262*b* and 264*b* to the borehole.

Figure 13A:
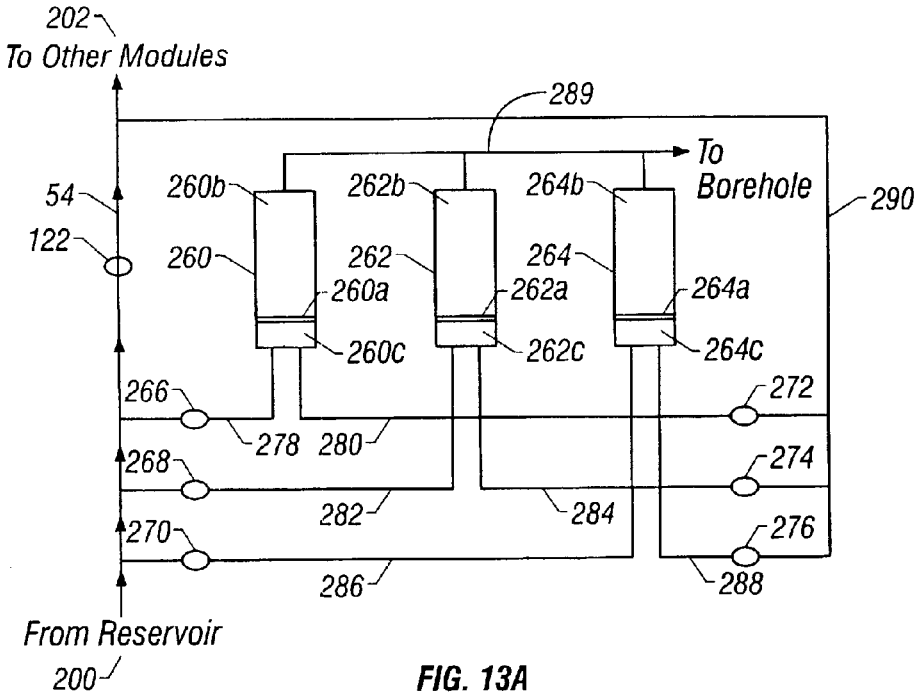
FIGS. 13A–D are sequential, schematic illustrations of multiple sample chambers connected in parallel and having flowlines selectively connecting a sample cavity of each sample chamber to the main flowline of a downhole sampling tool at a position above a sampling point of a reservoir, according to an embodiment of the present invention.

FIG. 13A depicts the flow of fluid through the tool prior to sampling. Valve 122 is open, and valves 266, 268, 270, 272, 274 and 276 are closed. In this position, formation fluid flows from the reservoir 200, through the main flowline 54, and to the other modules 202.

Figure 13B:
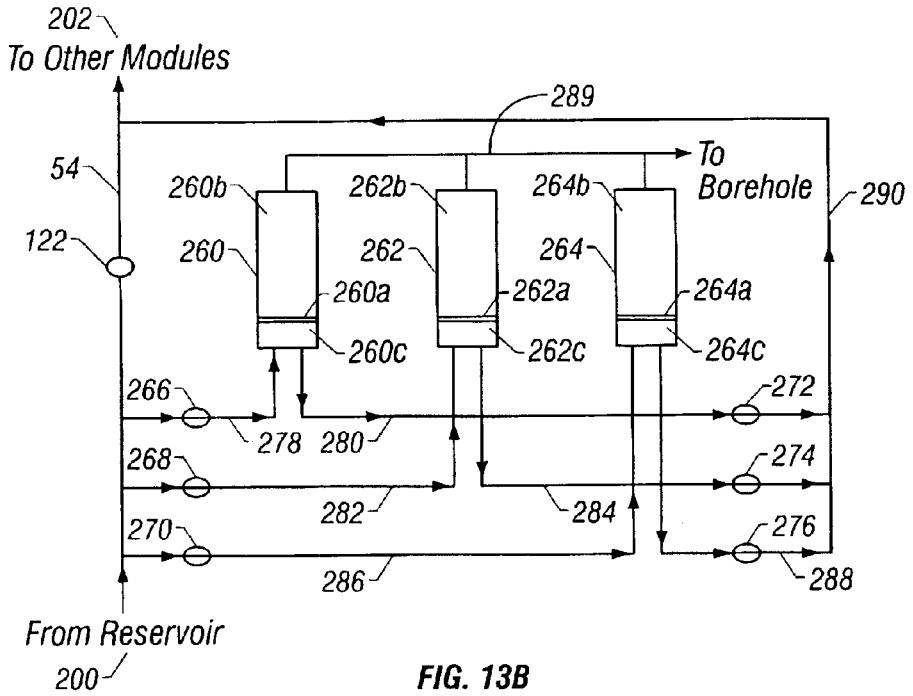

FIG. 13B depicts a dead volume flushing operation for flushing out contaminants in the flowlines 278, 280, 282, 284, 286, 288 and 290 and sample cavities 260*c*, and 264*c* of the sample chamber 260, 262 and 264. In this condition, the formation fluid flowing from reservoir 200 flows through flowline 54, into the flowlines 278, 282, 286 at a position between closed valve 122 and the reservoir, through the sample cavities 260*c*, 262*c* and 264*c* of the sample chambers 260, 262 and 264, through the flowlines 280, 284, and 288, through flowline 290, back to flowline 54 at a position between closed valve 122 and the other modules, and out to the other modules 202.

Figure 13C:
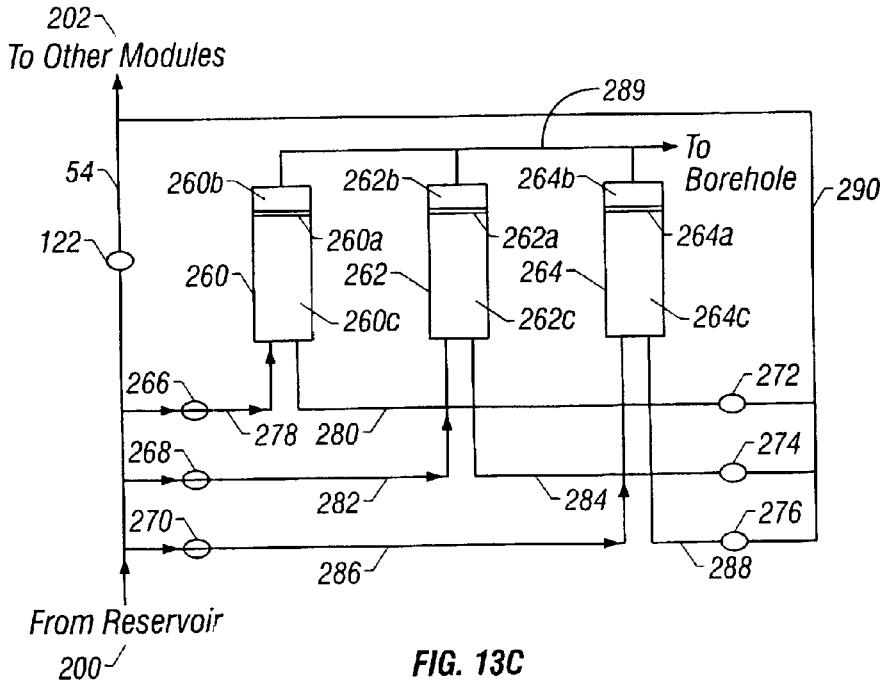

FIG. 13C depicts the sampling operation. Valve 122 is closed, valves 266, 268 and 270 are open, and valves 272, 274 and 276 are closed. In this condition, the formation fluid flows from the reservoir 200, through the main flowline 54, into flowlines 278, 282 and 286 at a position between closed valve 122 and the reservoir 200, into the sample cavities 260*c*, 262*c* and 264*c* of the sample chambers 260, 262 and 264. As the pressure of the formation fluid in the flowlines 278, 282, and 286 and in the sample cavities 260*c*, 262*c* and 264*c* increases, pistons 260*a*, 262*a* and 264*a* in sample chambers 260, 262 and 264 move upwardly thereby drawing a sample of the formation fluid into the sample cavities 260*c*, 262*c*, and 264*c* and expelling buffer fluid from the buffer cavities 260*b*, 262*b*, 264*b* out through flowline 289 to the borehole.

Figure 13D:
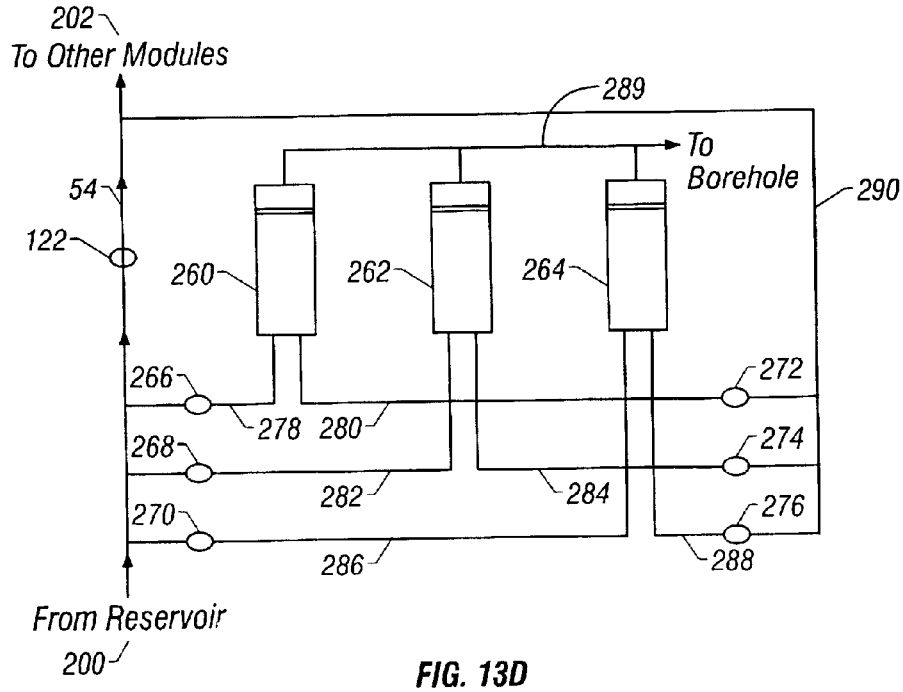

FIG. 13D depicts the flow of fluid in the downhole tool after sampling is complete. Valves 266, 268, 270, 272, 274, and 276 are closed, and the main flowline seal valve 122 is open. In this position, the formation fluid flows from the reservoir into the main flowline 54, and out to the other modules 202. At this point, one or more of the sample cavities is full and may either be removed for testing, or emptied for further sampling. The process may be repeated for multiple samples.

Figure 14A:
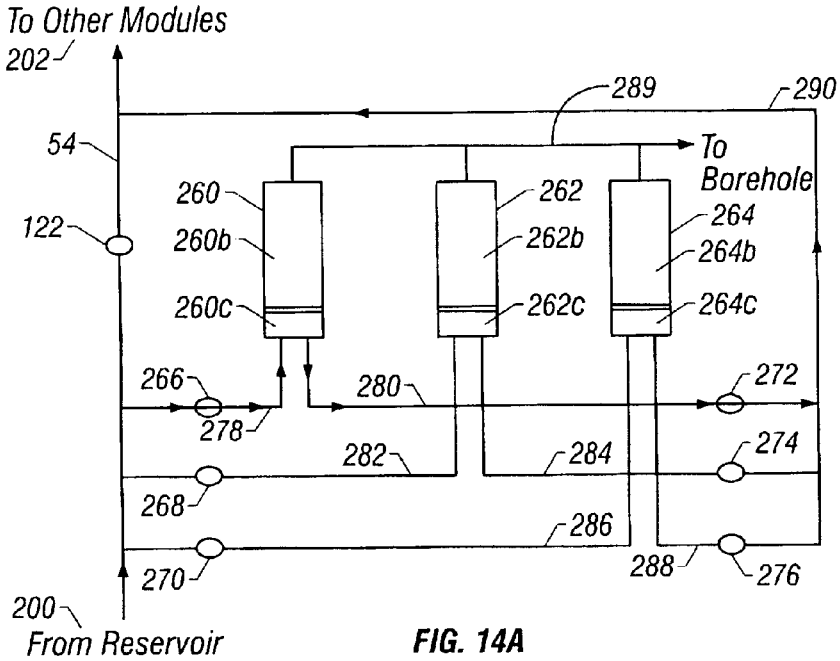
FIGS. 14A–C are sequential, schematic illustrations of the multiple sample chambers of FIGS. 13A–D with fluid flowing through only one of the multiple sample chambers according to an embodiment of the present invention.
Figure 14B:
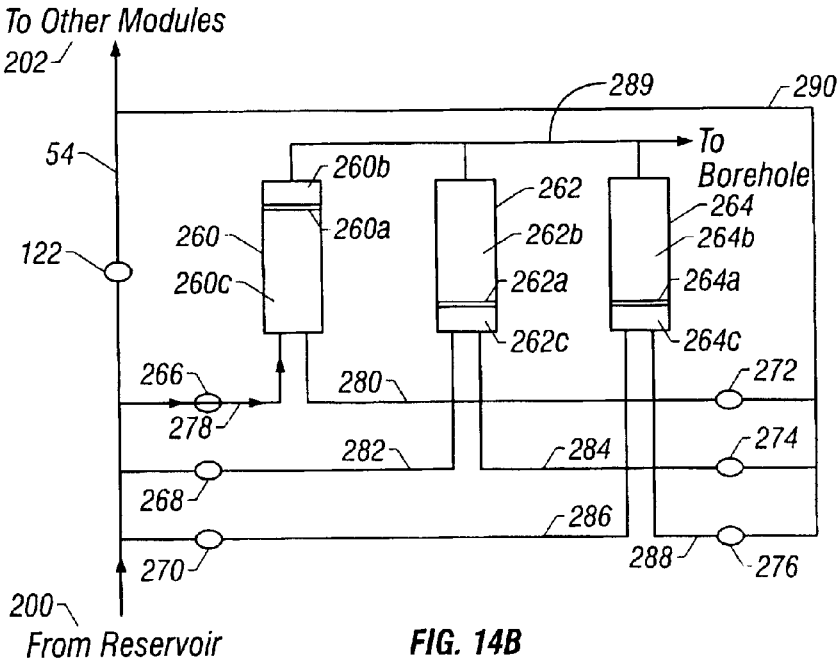
Figure 14C:
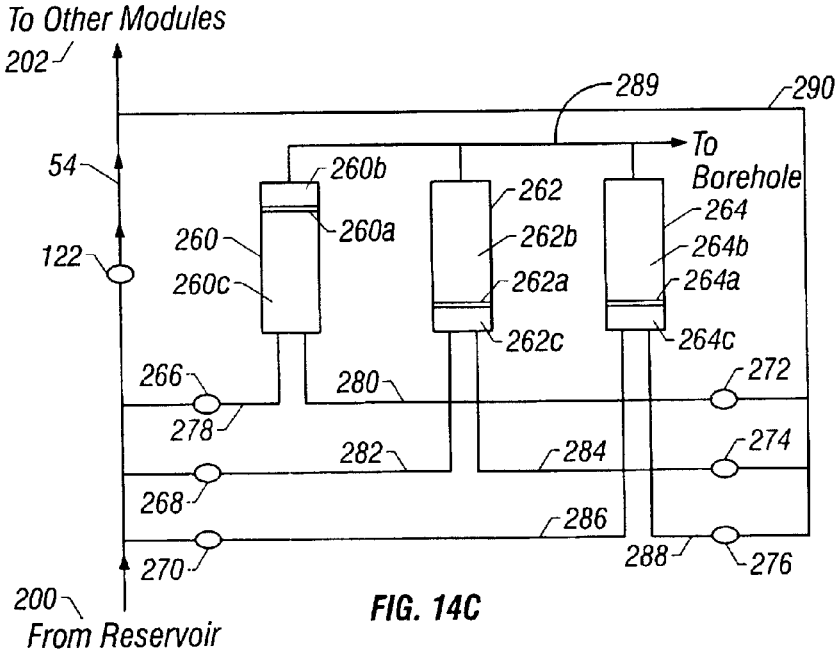

FIGS. 14A–14C depict a flushing and sampling operation in one of the sample chambers (e.g., the first sample chamber 260). Prior to performing the dead volume flushing, the apparatus may be in the position depicted in FIG. 13A.

FIG. 14A depicts the selective dead volume flushing operation for flushing out contaminants in the flowlines 278, 280 and 290 and sample cavity 260*c* of the sample chamber 260. In this condition, the formation fluid flowing from reservoir 200 through flowline 54, into flowline 278 at a position between closed valve 122 and the reservoir 200, through the sample cavity 260*c* of the sample chamber 260, through the flowlines 280, through flowline 290, back to flowline 54 at a position between valve 122 and the other modules 202, and out to the other modules 202. Valves 268, 270, 274, and 276 remain closed to prevent the flow of fluid into sample chambers 262 and/or 264. Thus, no dead volume flushing occurs in either of these sample chambers.

FIG. 14B depicts the selective sampling operation for sample chamber 260. Valves 268, 270, 272, 274, 276 and 122 are closed, and valve 266 is open. In this condition, the formation fluid flows from the reservoir 200, through the main flowline 54, into the flowline 278 at a position between closed valve 122 and reservoir 200, and into the sample cavity 260*c* of the first sample chamber 260. As the pressure of the formation fluid in the flowline 278 and in the sample cavity 260*c* increases, piston 260*a* in sample chambers 260 moves upwardly thereby drawing a sample of the formation fluid into the sample cavity 260*c* and expelling buffer fluid from the buffer cavity 260*c* out through flowline 289 to the borehole.

FIG. 14C depicts the flow of fluid in the downhole tool after sampling is complete. Valves 266, 268, 270, 272, 274, and 276 are closed and valve 122 is open. As a result, formation fluid from the sampling point of the reservoir 200 flows through the main flowline 54, and out to the other modules 202. At this point, the selected sample cavity is full and may either be removed for testing, emptied for further sampling, or held in place while the other sample chambers are filled. The process may be repeated for multiple samples.

Referring to FIGS. 15A–16D, another additional embodiment of the present invention is illustrated. In this embodiment, the buffer chamber is provided with a flowline 302 positionable in fluid connection with the main flowline 54. When a formation fluid sample is collected in a sample cavity of a sample chamber, buffer fluid in the buffer fluid cavity is expelled out to other modules via the main flowline 54.

In the embodiment of FIGS. 15A–15D, the sample chamber is located above the sampling point of the reservoir. Flowline 298 fluidly connects sample cavity 296*c* of sample chamber 296 to main flowline 54 at a position along flowline 54 between reservoir 200 and valve 122. Secondary flowline 300 fluidly connects sample cavity 296*c* of sample chamber 296 to main flowline 54 at a position along flowline 54 between valve 122 and other modules 202. Buffer flowline 302 fluidly connects the buffer chamber 296*c* to main flowline 54 at a position between valve 122 and other modules 202. Valve 292 is positioned along flowline 298, and valve 294 is positioned along flowline 300 to selectively allow fluid to flow through the flowlines. The sample chamber 296 includes a sample cavity 296*c* adapted for collecting a formation fluid sample and a buffer cavity 296*p* containing a buffer fluid separated by a movable piston 296*a*.

Figure 15A:
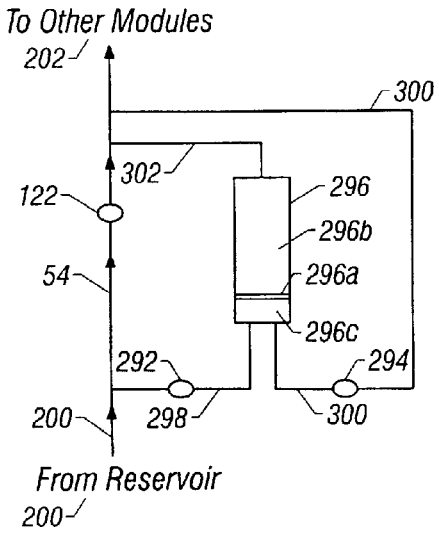
FIGS. 15A–D are sequential, schematic illustrations of a sample chamber having flowlines connecting a sample cavity and a buffer cavity of the sample chamber to a main flowline of a downhole sampling tool at a position above a sampling point of a reservoir according to an embodiment of the present invention.

FIG. 15A depicts the flow of fluid through the tool prior to sampling. Valve 122 is open, and valves 292 and 294 are closed. In this position, formation fluid flows from the reservoir 200, through the main flowline 54, and out to the other modules 202.

Figure 15B:
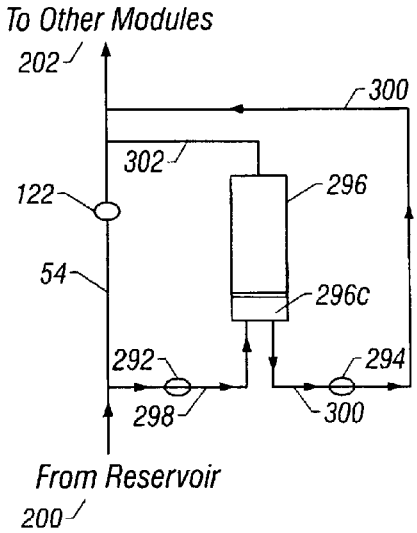

In FIG. 15B, a "dead volume flushing" operation is depicted. Valves 292 and 294 are opened, but valve 122 is closed. As a result, the formation fluid from the reservoir 200 flows, through flowline 54, into the flowline 298 at a position between the reservoir 200 and valve 122, into the sample cavity 296*c* of the sample chamber 296, into flowline 300, back to flowline 54 at a position between valve 122 and other modules, and out to the other modules 202.

Figure 15C:
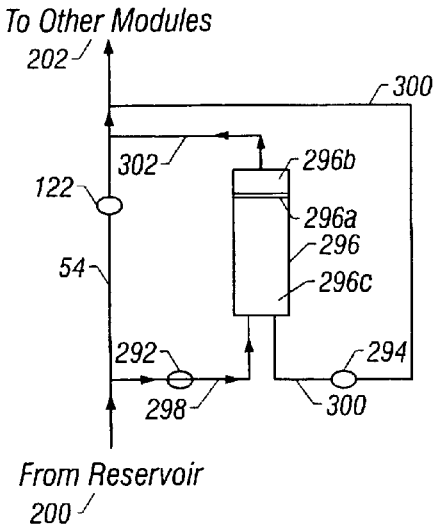

FIG. 15C depicts the sampling operation. The valves 122 and 294 are closed, and valve 292 is open. In this condition, the formation fluid flows from the reservoir 200, through flowline 54, into flowline 298 at a position between valve 122 and reservoir 200, and into the sample cavity 296*c* of the first sample chamber 296. As the pressure of the formation fluid in the flowline 298 and in the sample cavity 296*c* increases, piston 296*a* in sample chamber 296 moves upwardly thereby drawing a sample of the formation fluid into the sample cavity 296*c* and expelling buffer fluid from the buffer cavity 296*b*. Fluid expelled from buffer cavity 296*b* flows through flowline 302, into flowline 54 at a position between closed valve 122 and the other modules 202, and out to the other modules 202.

Figure 15D:
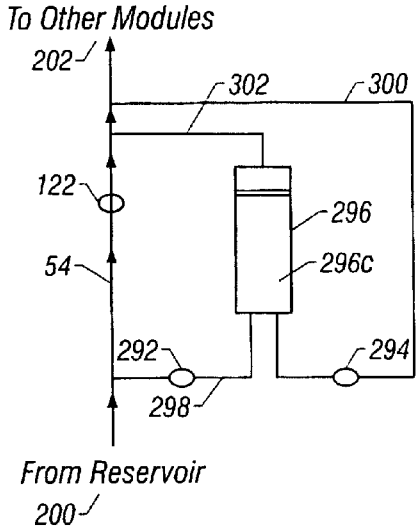

FIG. 15D depicts the flow of fluid in the downhole tool after sampling is complete. Valves 292 and 294 are closed, and valve 122 is open. In this position, the formation fluid flows from the reservoir 200 into the main flowline 54, and up to the other modules 202. At this point, the sample cavity 296*c* is full and may either be removed for testing, or emptied for further sampling. The process may be repeated for multiple samples.

In the embodiment of FIGS. 16A–16D, the sample chamber is located below the sampling point of the reservoir. Flowline 316 fluidly connects sample cavity 310*c* of sample chamber 310 to main flowline 54 at a position along flowline 54 between other modules 202 and valve 122. Flowline 318 fluidly connects sample cavity 310*c* of sample chamber 310 to main flowline 54 at a position along flowline 54 between valve 122 and the reservoir 200. Valve 312 is positioned along flowline 316, and valve 314 is positioned along flowline 318 to selectively allow fluid to flow through the flowlines. The sample chamber 310 includes a sample cavity 310*c* adapted for collecting a formation fluid sample and a buffer cavity 310*p* containing a buffer fluid separated by a movable piston 310*a*. Buffer flowline 320 fluidly connects the buffer chamber 310*c* to main flowline 54 at a position between valve 122 and other modules 202. As shown in FIGS. 16A–16D, flowline 320 connects to flowline 54 between valve 122 and flowline 316.

Figure 16A:
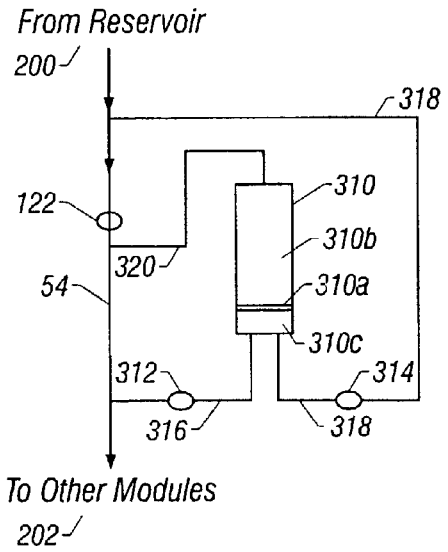
FIGS. 16A–D are sequential, schematic illustrations of the sample chamber of FIGS. 15A–D with the flowlines connecting the sample chamber to the main flowline of the downhole sampling tool at a position below a sampling point of a reservoir according to an embodiment of the present invention.

FIG. 16A depicts the flow of fluid through the tool prior to sampling. Valve 122 is open, and valves 312 and 314 are closed. In this position, formation fluid flows from the reservoir 200, through the main flowline 54 and out to the other modules 202.

Figure 16B:
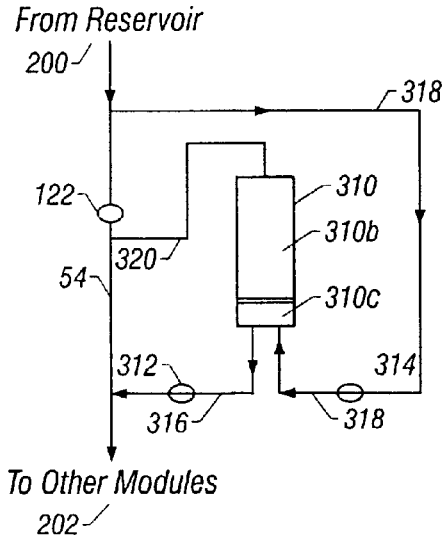

FIG. 16B depicts a dead volume flushing operation for flushing out contaminants in the flowlines 316 and 318 and sample cavity 310*c* of the sample chamber 310. In this condition, the formation fluid flowing from reservoir 200 flows through flowline 54, into flowline 318 at a position between closed valve 122 and reservoir 200, through the sample cavity 310*c* of the three sample chamber 310, through the flowline 316, back to flowline 54 at a position between closed valve 122 and the other modules and flows out to the other modules 202.

Figure 16C:
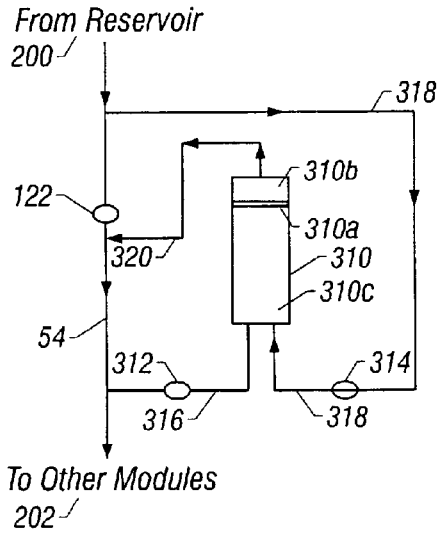

FIG. 16C depicts the sampling operation. Valves 122 and 312 are closed, and valve 314 is open. In this condition, the formation fluid flows from the reservoirs 200 flows through flowline 54, into flowline 318 at a position between reservoir 200 and valve 122, and into the sample cavity 310*c* of the first sample chamber 310. As the pressure of the formation fluid in the flowline 318 and in the sample cavity 310*c* increases, piston 310*a* in sample chamber 310 moves upwardly thereby drawing a sample of the formation fluid into the sample cavity 310*c* and expelling buffer fluid from the buffer cavity 310*b*. Fluid expelled from buffer cavity 310*b* flows through flowline 320, into flowline 54 at a position between closed valve 122 and flowline 316, and out to other modules.

Figure 16D:
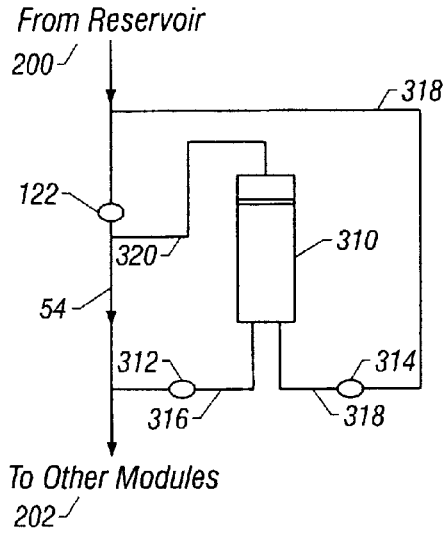

FIG. 16D depicts the flow of fluid in the downhole tool after sampling is complete. Valves 312 and 314 are closed, and valve 122 is open. In this position, the formation fluid flows from the reservoir 200 into the main flowline 54, and out to the other modules 202. At this point, the sample cavity is full and may either be removed for testing, or emptied for further sampling. The process may be repeated for multiple samples.

Figure 17A:
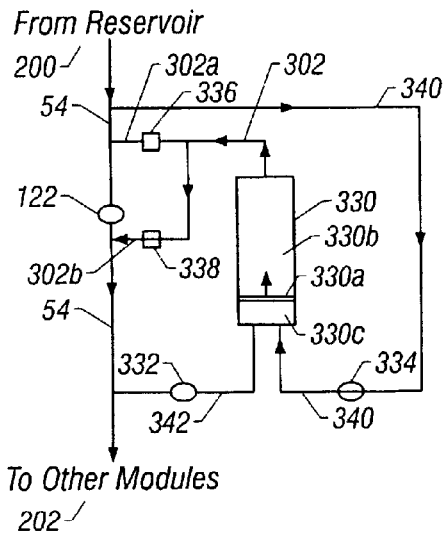
FIGS. 17A–B are sequential, schematic illustrations of a sample chamber having flowlines connecting a sample cavity and a buffer cavity of the sample chamber to a main flowline of a downhole sampling tool at a position below a sampling point of a reservoir, the buffer cavity selectively connected to the main flowline on alternate sides of a shut off valve in the main flowline according to an embodiment of the present invention.
Figure 17B:
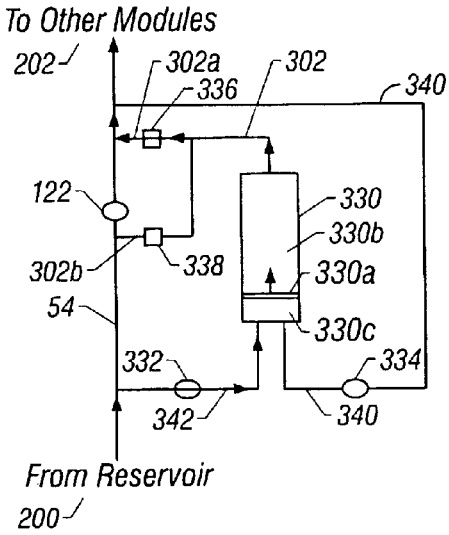

Referring to FIGS. 17A and 17B, another additional embodiment of the present invention is illustrated. In this embodiment, the buffer chamber is provided with a flowline positionable in fluid connection with the main flowline 54 either above or below valve 122. Thus, fluid may be selectively diverted from the sample cavity and/or the buffer cavity to either the reservoir or other modules. In this manner, the same configuration may used to perform the dead volume flushing and/or sampling operations when the sampling point is above or below the sample chamber by selectively opening and closing valves. While FIGS. 17A and 17B only depict the sampling process using this flexible approach, the flushing process may also be used in this configuration as previously described.

In FIG. 17A, the sampling point is above the sample chamber. Flowline 342 fluidly connects sample cavity 330*c* of sample chamber 330 to main flowline 54 at a position along flowline 54 between other modules 202 and valve 122. Flowline 340 fluidly connects sample cavity 330*c* of sample chamber 330 to main flowline 54 at a position along flowline 54 between valve 122 and reservoir 200. Valve 332 is positioned along flowline 342 and valve 334 is positioned along flowline 340 to selectively allow fluid to flow through the flowlines.

The sample chamber 330 includes a sample cavity 330*c* adapted for collecting a formation fluid sample and a buffer cavity 330*p* containing a buffer fluid separated by a movable piston 330*a*. Buffer flowline 302 fluidly connects the buffer chamber 330*b* via flowline 302*a* to main flowline 54 at a position between valve 122 and reservoir 200, and via flowline 302*b* to main flowline 54 at a position between valve 122 and other modules 202. Valve 336 is positioned along flowline 302*a* and valve 338 is positioned along flowline 302*b* to selectively allow fluid to flow through the flowlines. One or more of the valves, such as valves 336 and 338, may be manually pre-set in the open or closed position prior to sending the tool downhole for performing downhole operations.

As shown in FIG. 17A, valves 122 and 332 are closed, and valve 334 is open. Buffer valve 336 is closed and buffer valve 338 is open. In this position, formation fluid flows from the reservoir, through flowline 54, into flowline 340 at a position between reservoir 200 and valve 122, and into the sample cavity 330*c* of the sample chamber 330. Pressure builds up in flowline 340 and cavity 330*c* until piston 330*a* rises thereby drawing a sample into cavity 330*c* and expelling buffer fluid from buffer cavity 330*b*. Buffer fluid flows from cavity 330*b* through flowline 302, through flowline 302*b* and out to flowline 54 at a position between valve 122 and other modules 202, and out the other modules 202.

In FIG. 17B, the sampling point is below the sample chamber. The configuration of FIG. 17B is the same as that of FIG. 17A, except that the location of the other modules 202 and the reservoir 200 are reversed. As shown in FIG. 17B, valves 122 and 334 are closed, and valve 332 is open. Buffer valve 336 is open and buffer valve 338 is closed. In this position, formation fluid flows from the reservoir, through flowline 54, into flowline 342 at a position between valve 122 and reservoir 200, and into the sample cavity 330*c* of the sample chamber 330. Pressure builds up in flowline 342 and cavity 330*c* until piston 330*a* rises thereby drawing a sample into cavity 330*c* and expelling buffer fluid from buffer cavity 330*b*. Buffer fluid flows from cavity 330*b* through flowline 302, through flowline 302*a*, into flowline 54 between valve 122 and other modules 202, and out to the other modules 202.

Referring to FIGS. 18A–19B, another additional embodiment of the present invention is illustrated. In this embodiment, the multiple sample chambers are provided, and the buffer chamber is provided with a flowline positionable in fluid connection with the main flowline 54 either above or below valve 122. Thus, fluid may be selectively diverted from the sample cavity and/or the buffer cavity of one or more of the sample chambers to either the reservoir or other modules. In this manner, the same configuration may used to perform the dead volume flushing and/or sampling operations when the sampling point is above or below one or more sample chambers. FIGS. 18A–19B depicts the dead volume flushing and/or sampling process using this flexible approach for sampling in multiple chambers. Dead volume flushing may also be performed across these multiple chambers as previously described.

Figure 18A:
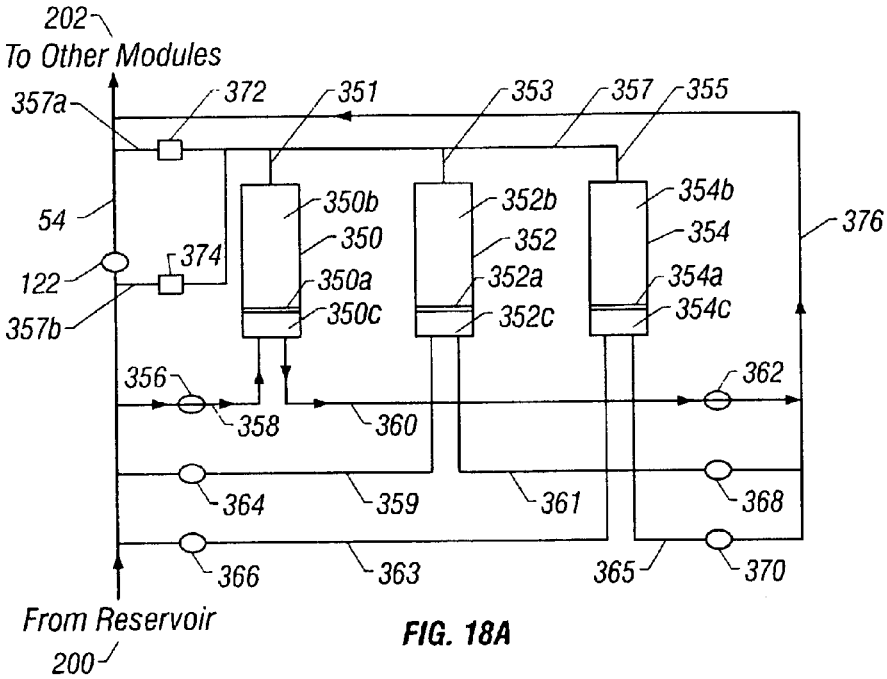
FIGS. 18A–B are sequential, schematic illustrations of multiple sample chamber connected in parallel, each sample chamber having flowlines connecting a sample cavity and a buffer cavity of the sample chamber to a main flowline of a downhole sampling tool at a position above a sampling point of a reservoir, the buffer cavity selectively connected to the main flowline on alternate sides of a shut off valve in the main flowline according to an embodiment of the present invention.
Figure 18B:
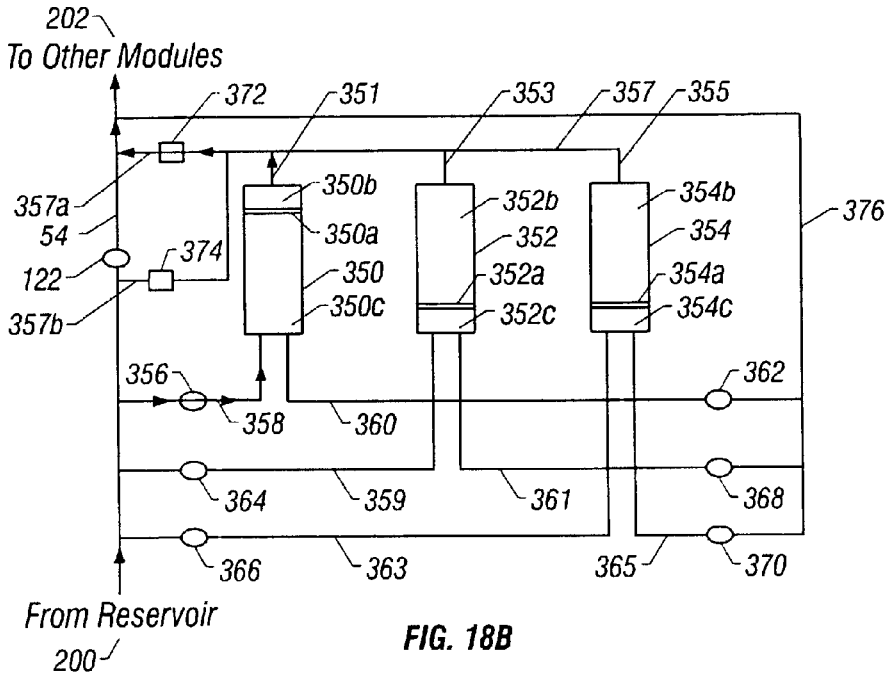

In the embodiments of FIGS. 18A and 18B, flowlines 358, 359, and 363 fluidly connect sample cavities 350*c*, 352*c*, and 354*c* of sample chambers 350, 352 and 354, respectively, to main flowline 54 at a position along flowline 54 between reservoir 200 and valve 122. Flowlines 360, 361 and 365 fluidly connects sample cavities 350*c*, 352*c* and 354*c* of sample chambers 350, 352 and 354, respectively, to flowline 376. Flowline 376 is then fluidly connected to flowline 54 at a position between valve 122 and other modules 202. Valves 356, 364 and 366 are positioned along flowlines 358, 359 and 363, respectively, and valves 362, 368 and 370 are positioned along flowlines 360, 361 and 365, respectively, to selectively allow fluid to flow therethrough.

The sample chambers 350, 352 and 354 include sample cavities 350*c*, 352*c* and 354*c*, respectively, adapted for collecting a formation fluid sample, and buffer cavities 350*b*, 352*b* and 354*b* containing a buffer fluid separated by movable pistons 350*a*, 352*a* and 354*a*. Buffer flowlines 351, 353 and 355 fluidly connect the buffer 350*c*, 352*c* and 354*c*, respectively, to flowline 357. Flowline 357 is fluidly connected via flowline 357*a* to main flowline 54 at a position between valve 122 and other modules 202, and via flowline 357*b* to main flowline 54 at a position between valve 122 and other reservoir 200.

In the embodiments of FIGS. 18A and 18B, the sampling point is located below the sample chambers. In FIG. 18A, a dead volume flushing operation is selectively performed in one of the sample chambers 350. Valve 122, manually set valves 372 and 374, and seal valves 364, 366, 368, 370 are closed, and seal valves 356 and 362 are open. In this condition, the formation fluid flowing in the main flowline 54 flows into flowline 358 at a position between valve 122 and reservoir 200, into the sample cavity 350*c*, into flowline 360, into the flowline 376, back into flowline 54 at a position between valve 122 and other modules 202, and out to the other modules 202. As a result, contaminants in flowline 358, sample cavity 350*c*, and flowline 360 are flushed out.

FIG. 18B depicts a sampling operation selectively performed in one of the sample chambers, namely sample chamber 350. Valves 122, 374, 362, 364, 366, 368, and 370 are closed, and valves 372 and 356 are open. As a result, formation fluid flows from flowline 54, flowline 358 at a position between valve 122 and reservoir 200, and into the sample cavity 350*c* of the first sample chamber 350. As a result, the pressure of the formation fluid in the sample cavity 350*c* of the first sample chamber forces the piston 350*a* to move upwardly thereby collecting a sample of the formation fluid in the first sample cavity 350*c*. Buffer fluid flows from buffer fluid cavity 350*b*, through flowline 351, through flowline 357, through flowline 357*a*, into flowline 54 at a position between valve 122 and other modules 202, and out to the other modules 202.

Figure 19A:
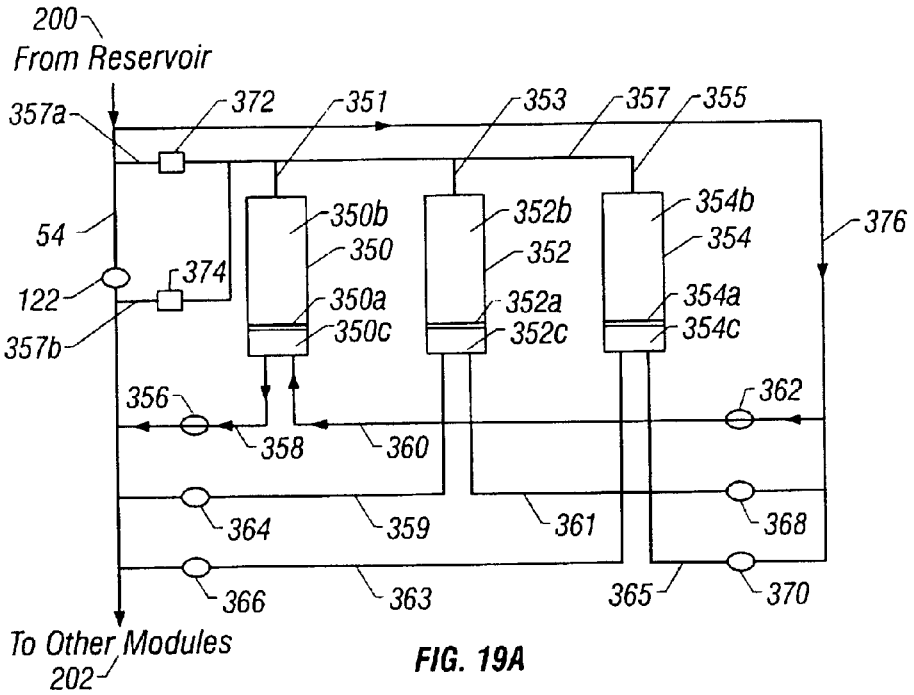
FIGS. 19A–B are sequential, schematic illustrations of the multiple sample of FIGS. 18A–B with fluid flowing through only one of the multiple sample chambers and the flowlines connecting the cavities of the sample chamber to the main flowline of the downhole sampling tool at a position below the sampling point of the reservoir according to an embodiment of the present invention.
Figure 19B:
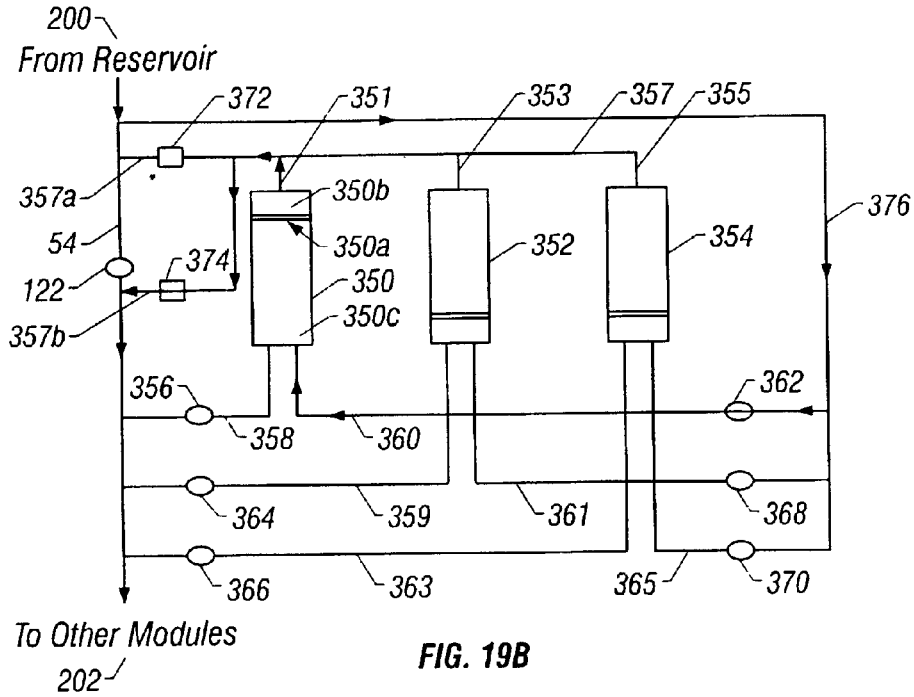

In the embodiments of FIGS. 19A and 19B, the sampling point is located above the sample chambers. The configuration of FIGS. 19A and 19B are the same as FIGS. 18A and 18B, except that the reservoir 200 and the other modules 202 is reversed. In FIG. 19A, a dead volume flushing operation is selectively performed in one of the sample chambers 350. Valve 122, manually set valves 372 and 374, and seal valves 364, 366, 368, 370 are closed, and seal valves 356 and 362 are open. In this condition, the formation fluid flowing in the main flowline 54 flows into flowline 376 at a position between valve 122 and reservoir 200, into flowline 360, into the sample cavity 350*c*, into the flowline 358, back into flowline 54 at a position between valve 122 and other modules 202, and out to the other modules 202. As a result, contaminants in flowlines 358, 360 and 376 and sample cavity 350*c* are flushed out.

FIG. 19B depicts a sampling operation selectively performed in one of the sample chambers, namely sample chamber 350. Valves 122, 372, 356, 364, 366, 368, and 370 are closed, and valves 374 and 362 are open. As a result, formation fluid flows from flowline 54, into flowline 376 at a position between valve 122 and reservoir 200, into flowline 360 and into the sample cavity 350*c* of the first sample chamber 350. As a result, the pressure of the formation fluid in the sample cavity 350*c* of the first sample chamber forces the piston 350*a* to move upwardly thereby collecting a sample of the formation fluid in the first sample cavity 350*c*. Buffer fluid flows from buffer fluid cavity 350*b*, through flowline 351, through flowline 357, through flowline 357*b*, into flowline 54 at a position between valve 122 and other modules 202, and out to the other modules 202.

The apparatuses and methods described herein are not limited to the specific embodiments contained herein and encompass various combinations of the configurations described. For example, one or more of the sample chambers of FIGS. 11A–19B may be provided with a pump as shown in FIGS. 7A–7D and/or a gas module as shown in FIGS. 8A–8D. Additionally, one or more sample chambers may be contained within the same sample module, stacked together within a sample module, or have multiple modules stacked together within the same MDT tool having a common main flowline therethrough. Sample modules having different sample chamber configurations may be combined within the same MDT tool. The sample chambers combined may optionally be inside a unitary or non-modular downhole sampling tool. Other variations may be envisioned.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A downhole sampling tool positionable in a wellbore penetrating a subterranean formation, comprising:

a main flowline extending through the downhole tool for conunonicating fluid obtained from the formation through the downhole tool;

a main valve in the main flowline movable between a closed and an open position, the valve defining a first portion and a second portion of the main flowline;

at least one sample chamber have a slidable piston therein defining a sample cavity and a buffer cavity, the sample cavity in selective fluid communication with the first portion of the main flowline via a first flowline and in selective fluid communication with the second portion of the main flowline via a second flowline;

wherein when the main valve is in the closed position, fluid communication is selectively established between the sample cavity and one of the first portion of the main flowline, the second portion of the main flowline and combinations thereof.

2. The downhole sampling tool of claim 1 further comprising a first valve in the first flowline, the valve movable between a closed position and an open position for selectively allowing fluid communication between the first portion of the main flowline and the sample cavity.

3. The downhole sampling tool of claim 2 further comprising a second valve in the second flowline, the valve movable between a closed position and an open position for selectively allowing fluid communication between the second portion of the main flowline and the sample cavity.

4. The downhole sampling tool of claim 3 wherein when the main valve is in the closed position, the first valve is in the open position and the second valve is in the closed position, fluid flows from the first portion of the main flowline into the sample cavity whereby a sample is collected.

5. The downhole sampling tool of claim 3 wherein when the main valve is in the closed position, the first valve is in the closed position and the second valve is in the open position, fluid flows from the second portion of the main flowline into the sample cavity whereby a sample is collected.

6. The downhole sampling tool of claim 3 wherein when the main valve is closed and the first and second valves are open, fluid flows through the first portion of the main flowline, the first flowline, the sample cavity, the second flowline and the second portion of the main flowline whereby fluid is flushed therefrom.

7. The downhole sampling tool of claim 3 wherein when the main valve is closed and the first and second valves are open, fluid flows through the second portion of the main flowline, the second flowline, the sample cavity, the first flowline and the first portion of the main flowline whereby fluid is flushed therefrom.

8. The downhole sampling tool of claim 3 wherein when the main valve is open and the first and second valves are closed, fluid flows through the first and second portions of the main flowline whereby the fluid bypasses the at least one sample chamber.

9. The downhole sampling tool of claim 1 wherein the buffer cavity is in fluid communication with the borehole via a third flowline.

10. The downhole sampling tool of claim 9 wherein the third flowline is in fluid communication with one of the first and second portion of the main flowline via the third flowline.

11. The downhole sampling tool of claim 9 wherein the third flowline is in selective fluid communication with one of the first and second portion of the main flowline via the third flowline.

12. The downhole sampling tool of claim 11 further comprising a third valve in the third flowline, the valve movable between a closed position and an open position for selectively allowing fluid communication between the main flowline and the buffer cavity.

13. The downhole sampling tool of claim 1 wherein the at least one sample chamber comprises a plurality of sample chambers.

14. The downhole sampling tool of claim 13 wherein the at least one sample chambers are fluidly connected in series.

15. The downhole sampling tool of claim 13 wherein the at least one sample chambers are fluidly connected in parallel.

16. The downhole sampling tool of claim 1 wherein the downhole tool is modular.

17. The downhole sampling tool of claim 1 further comprising a pump assembly for drawing fluid from the formation into the main flowline.

18. The downhole sampling tool of claim 1 further comprising a pressurization system for charging the buffer cavity to control the pressure of the collected sample fluid in the sample cavity via the floating piston.

19. The downhole sampling tool of claim 1 further comprising a probe assembly for establishing fluid communication between the apparatus and the formation when the apparatus is positioned in the wellbore.

20. A method for obtaining fluid from a subsurface formation penetrated by a wellbore, comprising:

positioning a formation testing apparatus within the wellbore, the testing apparatus comprising a sample chamber having a floating piston slidably positioned therein so as to define a sample cavity and a buffer cavity;

establishing fluid communication between the apparatus and the formation;

inducing movement of fluid from the formation through a main flowline in the apparatus;

diverting fluid from the main flowline into the sample cavity via a first flowline;

discharging fluid from the sample cavity via a second flowline whereby fluid is flushed from the sample cavity; and terminating the discharge of fluid from the sample cavity whereby a sample is collected in the sample cavity.

21. The method of claim 20, further comprising terminating the flow of fluid from the main flowline into the sample cavity whereby the fluid bypasses the sample chamber.

22. The method of claim 20 wherein a valve is positioned in the main flowline defining a first and second portion of the main flowline, the valve movable between an open and closed position.

23. The method of claim 22 wherein the step of diverting comprises diverting fluid from the first portion of the main flowline into the sample cavity via the first flowline.

24. The method of claim 23 wherein the step of discharging fluid comprises discharging fluid from the sample cavity into the second portion of the main flowline via a second flowline whereby fluid is flushed from the sample cavity.

25. The method of claim 22, further comprising discharging fluid from the buffer cavity into the second portion or the main flowline via a third flowline.

26. The method of claim 20, further comprising discharging fluid from the buffer cavity into the borehole.

27. The method of claim 22 wherein the step of diverting comprises sclectively establishing fluid communication between the sample cavity and the first portion of the main flowline via the first flowline.

28. The method of claim 27 wherein the step of discharging comprises selectively establishing fluid communication between the sample cavity and the second portion of the main flowline via the second flowline whereby fluid is flushed from the sample cavity.

29. A downhole sampling tool positionable in a wellbore penetrating a subterranean formation, comprising:

a probe assembly for establishing fluid communication between the apparatus and the formation when the apparatus is positioned in the wellbore;

a pump assembly for drawing fluid from the formation into the apparatus via said probe assembly;

a main flowline extending through the downhole tool for communicating fluid obtained from the formation through the downhole tool;

a main valve in the main flowline movable between a closed and an open position, the valve defining a first portion and a second portion of the main flowline; and a sample module for collecting a sample of the formation fluid drawn from the formation by said pumping assembly, said sample module comprising:

at least one sample chamber have a slidable piston therein defining a sample cavity and a buffer cavity, the sample cavity in selective fluid communication with the first portion of the main flowline via a first flowline and in selective fluid communication with the second portion of the main flowline via a second flowline;

wherein when the main valve is in the closed position, fluid communication is selectively established between the sample cavity and one of the first portion of the main flowline, the second portion of the main flowline and combinations thereof.

30. The downhole sampling tool of claim 29, further comprising a pressurization system for charging the pressurization cavity to control the pressure of the collected sample fluid in the sample cavity via the piston.

* * * * *